US006897890B2

(12) United States Patent
Sasaki

(10) Patent No.: US 6,897,890 B2
(45) Date of Patent: May 24, 2005

(54) RECORDING APPARATUS HAVING A RECTANGULAR PARALLELEPIPED LIGHT INTENSITY DISTRIBUTION

(75) Inventor: Yoshiharu Sasaki, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/983,918

(22) Filed: Oct. 26, 2001

(65) Prior Publication Data

US 2002/0057330 A1 May 16, 2002

(30) Foreign Application Priority Data

Oct. 26, 2000 (JP) ..... P2000-327218

(51) Int. Cl.[7] ..... B41J 2/47
(52) U.S. Cl. ..... 347/253
(58) Field of Search ..... 347/131–132, 347/135–136, 252–254, 236, 240, 246, 251, 241, 256, 244, 257; 430/20, 394; 358/480; 359/204; 369/112.28; 219/121.6

(56) References Cited

U.S. PATENT DOCUMENTS

| | | | | |
|---|---|---|---|---|
| 4,270,149 A | * | 5/1981 | Ohta et al. | 358/480 |
| 4,315,130 A | * | 2/1982 | Inagaki et al. | 219/121.6 |
| 4,811,328 A | * | 3/1989 | Ito et al. | 369/112.28 |
| 5,134,426 A | * | 7/1992 | Kataoka et al. | 347/244 |
| 5,171,650 A | * | 12/1992 | Ellis et al. | 430/20 |
| 5,657,071 A | * | 8/1997 | Shinohara | 347/252 |
| 5,717,511 A | * | 2/1998 | Suzuki | 359/204 |
| 6,034,713 A | * | 3/2000 | Kerr et al. | 347/257 |
| 6,291,145 B1 | * | 9/2001 | Kokubo et al. | 430/394 |

FOREIGN PATENT DOCUMENTS

| | | | | |
|---|---|---|---|---|
| EP | 0 941 860 A2 | * | 9/1999 | B41J/2/44 |
| JP | 11-277831 | | 10/1999 | B41J/17/00 |
| JP | 2001-51223 | * | 2/2003 | G02B/26/10 |

OTHER PUBLICATIONS

Reshaping collimated laser beams with Gaussian profile to uniform profiles, Chang–Yuan Han et al, Applied Optics/vol. 22, No. 22/Nov. 15, 1983, pp. 3644, 3645, 3646 and 3647.

Laser beam forming system, Nemoto et al of the Central Research Institute of Electric Power Industry, 18$^{TH}$ Optical Symposium (1993).

* cited by examiner

*Primary Examiner*—Hai Pham
(74) *Attorney, Agent, or Firm*—Sughrue Mion, PLLC

(57) ABSTRACT

To provide a recording apparatus capable of executing the stable recording not to waste the light energy even when the power/wavelength of the light beam in the recording apparatus, that records the image/characters onto the recording medium like the data by employing the light beam, are changed, the circumstances such as the temperature, the humidity, etc. are changed, and the recording velocity is changed.

A recording apparatus comprises a recording medium fixing member for fixing a recording medium that consists of a superposition of a transfer film and a receiver film, a main scanning direction moving device for moving the recording medium fixing member, a laser recording head for emitting a light beam, and a vertical scanning direction moving device for moving the light beam emitted from the laser recording head in a vertical scanning direction that is perpendicular to the main scanning direction, wherein a light intensity distribution of the light beam is almost a rectangular parallelepiped.

1 Claim, 19 Drawing Sheets

FIG.16

1 : WRAP THE IMAGE RECEIVING SHEET 10 ONTO THE DRUM 60

2 : WRAP THE K-TRANSFER SHEET

PRESSURIZATION/HEATING

SQUEEZE PROCESS AS OCCASION DEMANDS

3 : LASER RECORDING BASED ON K-DATA

4 : K-PEEL OFF (K OF THE LASER IRRADIATED AREA REMAINS)

5 : WRAP THE C-TRANSFER SHEET

6 : LASER RECORDING BASED ON C-DATA

7 : C-PEEL OFF

8 : WRAP THE M-TRANSFER SHEET

9 : LASER RECORDING BASED ON M-DATA

10 : M-PEEL OFF

11 : WRAP THE Y-TRANSFER SHEET

12 : LASER RECORDING BASED ON Y-DATA

13 : Y-PEEL OFF

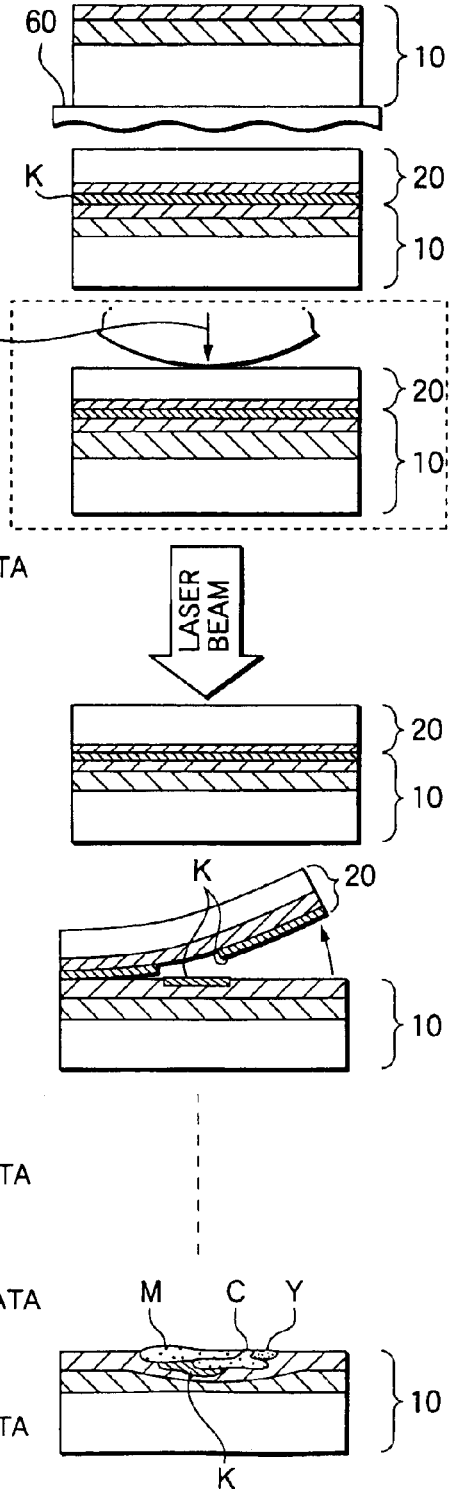

RECORDING APPARATUS HAVING A RECTANGULAR PARALLELEPIPED LIGHT INTENSITY DISTRIBUTION

BACKGROUND OF THE INVENTION

1. Field of the Invention

The present invention relates to a recording apparatus for forming images and characters by irradiating a light beam onto a recording medium that is fitted to a rotating recording drum and, more particularly, a recording apparatus that has the good recording property of a fine line without reduction in concentration and does not waste a recording energy.

2. Description of the Related Art

In recent years, there is employed a system that forms an image on a printing sheet by thermally transferring heat-sensitive material onto an image receiving sheet in response to image information by using a recording apparatus, which employs a recording head such as a laser light source, etc., and then passing the image receiving sheet and the printing sheet, superposed on this image receiving sheet, through an image transferring device to transfer the image formed on the image receiving sheet onto the printing sheet.

Meanwhile, the laser recording head employed in the recording apparatus of this type in the prior art to have the light intensity distribution of the light beam having the Gaussian profile as shown in FIG. 4 is employed. In other words, assume that the X-axis is a sub-scanning direction, the Y-axis is a main scanning direction, and the Z-axis is the light intensity (mW/$\mu$m$^2$) in FIG. 4, the light intensity becomes maximum at a location where the X-axis is 0 and the Y-axis is 0 and then the light intensity is reduced as the position goes far from the location where the X-axis is 0 and the Y-axis is 0.

Accordingly, if this light intensity in the main scanning direction is integrated every sub-scanning direction, integral values of the light intensity exhibit the Gaussian profile as shown in FIG. 5. In FIG. 5, assume that the abscissa is the sub-scanning direction and the ordinate is the integral value (mW/$\mu$m) of the light intensity in the main scanning direction, the light intensity at the location where the X-axis is 0 is 18 (mW/$\mu$m) at a maximum, and then the light intensity is reduced as the position goes far from the location where the X-axis is 0 on positive/negative directions and then becomes close to 0 at locations of ±8 $\mu$m.

By the way, since a thickness of the line, which is recorded at a predetermined velocity by the light beam in FIG. 4, is determined as a range where the integral value of the light intensity in the main scanning direction is equal to or more than 9 mW/$\mu$m as shown in FIG. 6, a line width is in the range of ±2.8 $\mu$m from the location where the X-axis is 0, i.e., a diameter is about 5.6 $\mu$m.

Therefore, for example, if the power of the light beam is varied to increase by 10%, the range is varied as shown in FIG. 7. That is, the line width is determined with the range where the integral value of the light intensity in the main scanning direction is in the range of more than 9 mW/$\mu$m, the line width is in the range of ±3.05 $\mu$m from the location where the X-axis is 0, i.e., the diameter is about 6.1 $\mu$m. That is, the line width is increased by about 10 from 5.6 $\mu$m in FIG. 6 to 6.1 $\mu$m in FIG. 7.

Also, if either humidity is reduced by about 20% or a recording velocity is increased by about 20%, the sensitivity is lowered by almost 10%. Thus, since the integral value of the recorded light intensity in the main scanning direction is in the range of more than almost 10 mW/$\mu$m as shown in FIG. 8, the line width becomes about 5.3 $\mu$m. That is, the line width is reduced by about 5% from 5.6 $\mu$m in FIG. 6 to 5.3 $\mu$m in FIG. 8. In this manner, it was found that, if the recording is carried out by the light beam having the Gaussian profile in the prior art, the line width is changed due to various factors. If so, it is impossible to get the predetermined concentration stably when external and internal noises (error factors) are present.

SUMMARY OF THE INVENTION

Therefore, in order to overcome the above, the applicant of this application thought of the use of the light beam that has a substantially constant light intensity in the sub-scanning direction.

For example, as shown in FIG. 9, there is the light beam that has the constant light intensity distribution in the sub-scanning direction and the light intensity distribution having the Gaussian profile in the main scanning direction. That is, assume that the X-axis is the sub-scanning direction, the Y-axis is the main scanning direction, and the Z-axis is the light intensity (mW/$\mu$m$^2$) in FIG. 9, the light intensity becomes the maximum and constant on the line where the Y-axis is 0 over the range where the X-axis is within ±3 $\mu$m and is reduced to form the Gaussian profile as the location is remote from the 0 point on the Y-axis. However, it can be seen that the light intensity is constant over the range where the X-axis is within ±3 $\mu$m on any line along the Y-axis.

The light beam having such profile in FIG. 9 can be obtained by passing the laser beam emitted from the multi-mode type semiconductor laser through the predetermined optical system. That is, normally it has been known that, in the multi-mode type semiconductor laser, the far field pattern (light intensity distribution) in the vertical direction to the active layer is the Gaussian profile and the far field pattern in the horizontal direction to the active layer is almost the rectangle.

Accordingly, if the light beam having such profiles is passed through the predetermined optical system as it is and optical magnifications in the vertical direction/ horizontal direction are set to predetermined magnifications, it is relatively easily possible to obtain the light beam shown in FIG. 9.

In this manner, the light intensity is constant over the predetermined range of the X-axis on any line in the Y-axis. Therefore, the integral values of the above light beam in the main scanning direction at every sub-scanning direction are shown in FIG. 10.

In FIG. 10, assume that the abscissa is the sub-scanning direction and the ordinate is the integral value (mW/$\mu$m) of the light intensity in the main scanning direction, the light intensity becomes maximum and constant like 17 (mW/$\mu$m) in the range where the X-axis is within ±3 $\mu$m, and becomes 0 when the location goes far from the location where the X-axis is ±4 $\mu$m.

In this case, as the thickness of the line that is recorded at a predetermined velocity by the light beam in FIG. 9, the line width is 3.45×2=6.9 $\mu$m, as can be seen from FIG. 10, since the integral value of the light intensity in the main scanning direction is in the range of more than almost 9 mW/$\mu$m.

Therefore, when the power of the light beam is varied to increase by 10%, FIG. 11 is obtained. That is, assume that the abscissa is the sub-scanning direction and the ordinate is the integral value (mW/$\mu$m) of the light intensity in the main scanning direction in FIG. 11, the thickness of the line recorded at the predetermined velocity by the light beam in FIG. 9, i.e., the line width becomes about 7.0 μm since the integral value of the light intensity in the main scanning direction is in the range of more than about 9 mW/μm. Namely, the line width becomes thick from 6.9 μm in FIG. 10 to 7.0 μm in FIG. 11 slightly by about 2% only. It can been seen that there is a marked difference from the case where, if the power of the light beam is varied to increase by 10%, the line width becomes thick by about 10% in the previous case in the prior art.

Then, if the humidity is lowered by 20% or the recording velocity is increased by about 20%, FIG. 12 is obtained since the range of the integral value of the light intensity in the main scanning direction is in the range of more than about 10 mW/μm, and the line width becomes about 6.8 μm. That is, the line width becomes thin from 6.9 μm in FIG. 10 to 6.8 μm in FIG. 12 slightly by about 2% only.

In this manner, it can be found that, if the image is recorded by the light beam having the sub-rectangular shape, the line width is difficult to change due to various external and internal noises (error factors).

In this fashion, as shown in FIG. 9, this light beam has the Gaussian profile distribution in the main scanning direction and the rectangular profile distribution in the sub-scanning direction. If the integral value of the light intensity of the light beam in the main scanning direction is measured, the result is shown in FIG. 10. That is, assume that the abscissa is the sub-scanning direction (μm) and the ordinate is the integral value (mW/μm) of the light intensity in the main scanning direction, the measured value of the light intensity is 17 within 3 μm from the center 0 of the sub-scanning direction on the left and right directions, but the light intensity becomes 0 at 4 μm on the left and right directions.

Therefore, if the threshold level of the recordable light intensity is set to 9 (mW/μm), it can be understood that the integral value of the light intensity over the threshold, that affects the recording, (S2 portion in FIG. 10) considerably remains. In FIG. 10, the integral value needs merely about 9 (mW/μm). The integral value of the light intensity under the threshold, that does not affect the recording, appears on both sides (S3 and S4 portions in FIG. 10), but it is excellent rather than the previous prior art that this value is very small.

However, if the integral value of the light intensity of the light beam in the sub-scanning direction is measured every main scanning direction, the result has the Gaussian distribution around the center point 0 in the main scanning direction, as shown in FIG. 13. That is, the light intensity of the light beam has a curve that is gradually increased in the main scanning direction to reach the peak and then is gradually decreased.

Accordingly, it can be seen that the portion S5 that exceeds the threshold about 0.7 ($mW/\mu m^2$) of the integral value of the light intensity in the sub-scanning direction exists considerably wide and thus the optical energy is wasteful.

Also, it can be seen that portion S6, S7 that are below the threshold about 0.7 ($mW/\mu^2$) of the integral value of the light intensity in the sub-scanning direction are also present considerably wide and thus the optical energy is also wasteful.

Therefore, the present invention intends to eliminate the waste of an optical energy of a sub-scanning direction every main scanning direction.

In order to overcome the above subjects, a first aspect of the present invention is a recording apparatus for recording images and characters onto a recording medium by employing a laser recording head to emit a light beam, wherein a light intensity distribution of the light beam is almost a rectangular parallelepiped.

A second aspect of the present invention is a recording apparatus which comprises a recording medium fixing member for fixing a recording medium that consists of a superposition of a transfer film and a receiver film; a main scanning direction moving device for moving the recording medium fixing member; a laser recording head for emitting a light beam; and a sub-scanning direction moving device for moving the light beam emitted from the laser recording head in a sub-scanning direction that is perpendicular to the main scanning direction; wherein a light intensity distribution of the light beam is almost a rectangular parallelepiped.

A third aspect of the present invention is a recording apparatus which comprises a recording medium fixing member for fixing a recording medium that consists of a superposition of a transfer film and a receiver film; a main scanning direction moving device for moving the recording medium fixing member; a laser recording head for emitting a plurality of light beams to form light beam spots that are to be one-dimensionally or two-dimensionally aligned; and a sub-scanning direction moving device for moving the plurality of light beams emitted from the laser recording head in a sub-scanning direction that is perpendicular to the main scanning direction; wherein light intensity distributions of the light beams emitted from the laser recording head are almost a rectangular parallelepiped respectively.

A fourth aspect of the present invention is a recording method of recording images and characters onto a recording medium by overlapping a toner layer of the transfer film, which is a binary heat mode recording medium, and an image receiving layer of a receiver film to fix them onto a recording medium fixing member, setting a moving direction of the recording medium as a main scanning direction, and moving a laser recording head, which emits a light beam onto the recording medium, in a sub-scanning direction that is perpendicular to the main scanning direction, wherein the light beam from the laser recording head, whose light intensity distribution is almost a rectangular parallelepiped, is employed.

BRIEF DESCRIPTION OF THE DRAWINGS

FIG. 16 is a view showing a recording step of executing the laser-recording by employing the image receiving sheet and respective transfer sheets of KCMY, both having the structure in FIG. 15, and a peeling step after the recording.

DESCRIPTION OF THE PREFERRED EMBODIMENTS

First, a recording apparatus that is treated as an object by the present invention will be explained hereunder.

Figure 14:
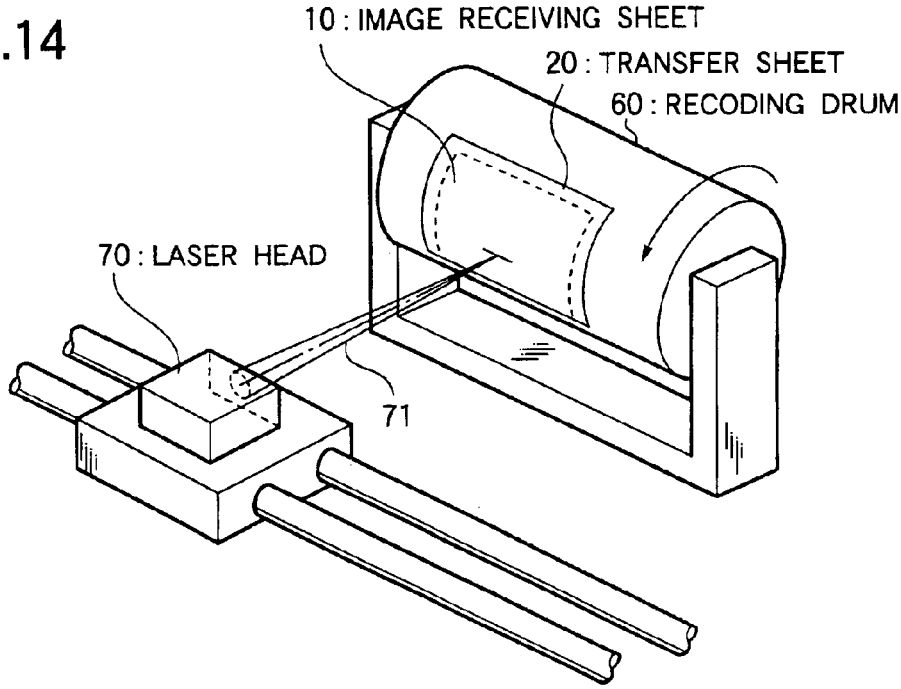
FIG. 14 is a view showing an example of a configuration of a recording apparatus employing a laser head that is treated as an object by the present invention.

FIG. 14 shows an example of a configuration of a recording apparatus of this type. This recording apparatus is constructed to form a two-dimensional image onto a recording medium by irradiating a laser beam 71 that is emitted from a laser head 70 having a laser light source (LD) onto the recording medium of an overlapping sheet that consists of an image receiving sheet 10 fitted to a recording drum 60 and a transfer sheet 20 for covering this image receiving sheet 10, while rotating the recording drum 60 in a direction indicated by an arrow and moving the laser head 70 in a direction in parallel with an axial direction of the recording drum 60. The laser head 70 has a light emitting element (not shown) for emitting the laser beam 71 or has the light emitting element and a light modulating element for modulating the laser beam emitted from the light emitting element.

Figure 15:
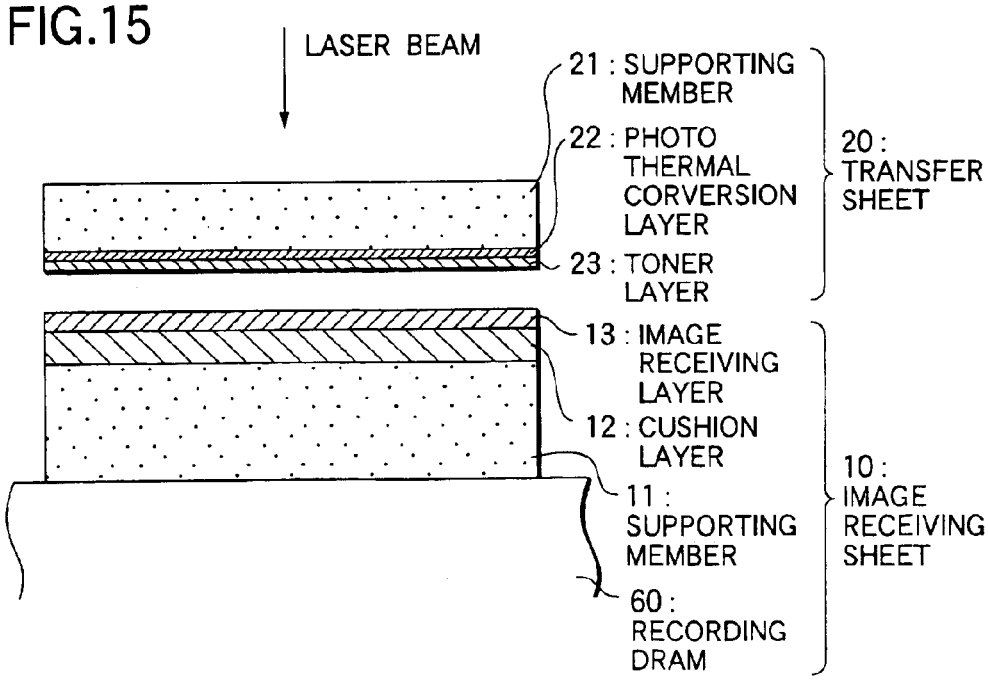
FIG. 15 is a view showing a configuration of the image receiving sheet and the transfer sheet loaded on a recording drum.

Respective configurations of the image receiving sheet 10 and the transfer sheet 20 loaded on the recording drum 60 are shown in FIG. 15. In FIG. 15, the image receiving sheet 10 is composed of a supporting member 11, a cushion layer 12, and an image receiving layer 13 in sequence from the recording drum 60 side.

Also, the transfer sheet 20 for covering the image receiving sheet 10 is composed of a supporting member 21, a photothermal conversion (IR) layer 22, and a toner layer 23 in sequence from the laser beam irradiating side.

This image receiving sheet 10 is fitted to the recording drum 60, the transfer sheet 20 is superposed onto the image receiving sheet 10 such that the toner layer is directed to the image receiving sheet 10 side. Thus, when the laser beam is irradiated to the transfer sheet 20 from the opposite side of the image receiving sheet 10 side, such laser beam can transmit through the supporting member 21 since such member is transparent, whereby the irradiated portion of the toner layer 23 is transferred onto the image receiving layer 13 by the heat.

Here, the substance that can transmit the laser beam, e.g., PET (polyethylene terephthalate) base, TAC (triacetylcellulose) base, PEN (polyethylene naphthalate) base, etc. may be employed as the supporting body. Also, the substance that can convert the laser energy into the heat effectively, e.g., carbon, black substance, infrared absorption pigment, specific wavelength absorption material, etc. may be employed as the photothermal conversion layer. The transfer sheets of respective colors of K (black), C (cyan), M(magenta), Y(yellow) are contained in the toner layer. Sometimes the transfer sheets of special colors of gold, silver, brown, gray, orange, green, etc. may be employed. The image receiving layer receives the transferred toner. In addition, the cushion layer act to absorb the level-difference caused when the toner is laminated in plural stages and to absorb the level-difference caused by the dust.

More detailed contents of the image receiving sheet 10 and the transfer sheet 20 as the recording medium employed in the recording apparatus are set forth in JP(OPI)H4-296594, JP(OPI)H4-327982, JP(OPI)H4-327983, etc. filed by the applicant of this application, and also the recording apparatus employing such recording medium is described in detail in JP(OPI)H11-277831. Therefore, please see them as occasion demands.

Next, the laser recording step of executing the laser-recording by employing the image receiving sheet 10 and the transfer sheets 20 having the structure in FIG. 15 the peeling step of peeling off respective transfer sheets 20 from the image receiving sheet 10 after the recording will be explained with reference to FIG. 16.

1) Wrap the image receiving sheet 10 onto the recording drum 60.

2) First, in order to execute the K step, wrap the K-transfer sheet 20 on the image receiving sheet 10.

Execute the squeeze process as occasion demands (the adhesiveness between the image receiving sheet 10 and the K-transfer sheet 20 is enhanced by the slight pressurization/heating).

3) Irradiate the laser beam based on the image/character data to execute the recording.

4) Then, when the K-transfer sheet 20 is peeled off from the image receiving sheet 10, only the K portion onto which the laser beam is irradiated is transferred to the image receiving layer of the image receiving sheet 10, but other K portion onto which the laser beam is not irradiated is peeled off while sticking to the K-transfer sheet 20 (the K step is ended).

5) Although not depicted in drawings, the same steps are applied in the C step and followings. That is, wrap the C-transfer sheet onto the image receiving sheet 10.

6) Execute the laser recording based on C-data.

7) Peel off the C-transfer sheet 20 from the image receiving sheet 10 (The C step is ended).

8) Then, execute the M-step. That is, wrap the M-transfer sheet 20 onto the image receiving sheet 10.

9) Execute the laser recording based on M-data.

10) Peel off the M-transfer sheet 20 from the image receiving sheet 10 (The M step is ended).

11) Then, execute the Y step. That is, wrap the Y-transfer sheet 20 onto the image receiving sheet 10.

12) Execute the laser recording based on Y-data.

13) Finally, peel off the Y-transfer sheet 20 from the image receiving sheet 10 (The Y step is ended).

In this manner, four colors of KCMY are laminated appropriately on the image receiving sheet 10 or not laminated to form the image, and thus the desired color image can be formed.

Then, this is transferred onto the printing sheet.

Figure 17A:
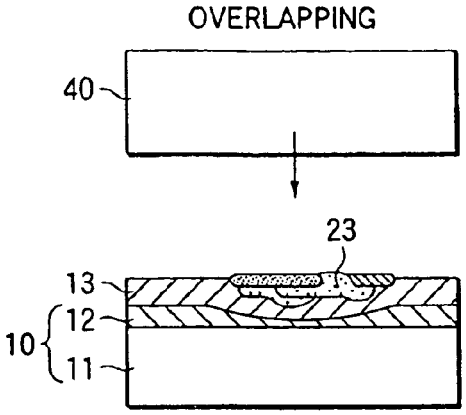
PRIOR ART FIG.17A
FIG. 17 is a view showing the step of transferring four KCMY colors on the image receiving sheet onto the printing sheet in the prior art.
Figure 17B:
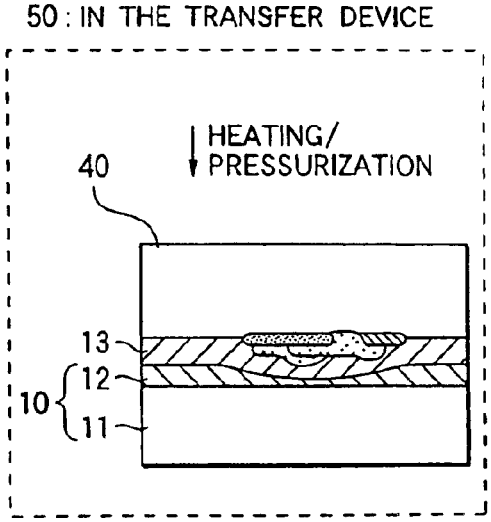
PRIOR ART FIG.17B
Figure 17C:
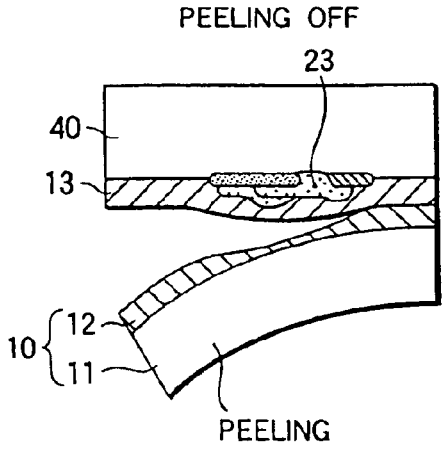
PRIOR ART FIG.17C

1) FIG. 17 is a view showing the steps, in the prior art, of transferring four colors of KCMY on the image receiving sheet 10 obtained by the steps in FIG. 16 onto the printing sheet. In FIG. 17(*a*), four colors of KCMY are laminated appropriately on the image receiving layer 13 of the image receiving sheet 10 via the cushion layer 12 on the supporting member 11. The printing sheet 40 is overlapped on this.

2) They are put into the transfer device 50 in such overlapped state. Since two heat rollers (or the heat roller and the normal roller) to which the pressure is applied are provided in the transfer device 50, the overlapped sheet is passed through between two heat rollers (FIG. 17(*b*)).

3) Then, if the image receiving sheet 10 is peeled off from the printing sheet 40, both are released mutually at the cushion layer 12 of the image receiving sheet 10 as the boundary. Thus, respective colors of KCMY wrapped by the image receiving layer 13 are transferred onto the printing sheet side and then the printing sheet exhibiting the predetermined colors can be obtained (FIG. 17(*c*)). In this case, the image receiving sheet 10 side being peeled off is subjected to the disposal process.

Figure 18:
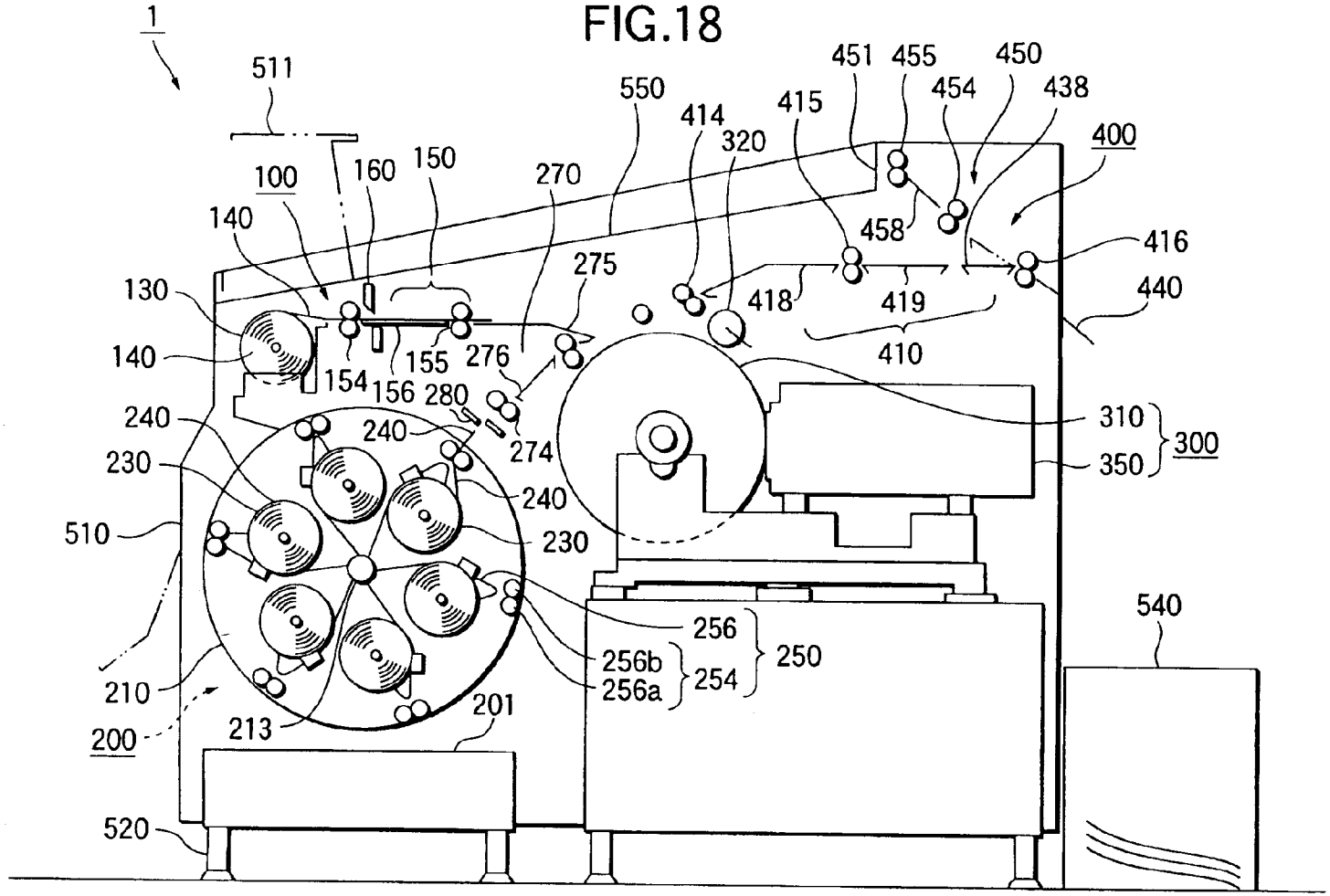
FIG. 18 is a longitudinal sectional view showing an outline of the recording apparatus that embodies the recording method.

FIG. 18 is a longitudinal sectional view showing an outline of the recording apparatus that embodies the recording method. As shown in FIG. 18, the recording apparatus 1 comprises an image receiving sheet supplying portion 100, a transfer sheet supplying portion 200, a recording portion 300, and a ejecting portion 400. Also, a surface of the recording apparatus 1 is covered with a main body cover 510 and is supported by leg portions 520.

In the recording apparatus 1, the image receiving sheet supplying portion 100 supplies the image receiving sheet to the recording portion 300. Also, the transfer sheet supplying portion 200 can supply plural type transfer sheets, and can supply selectively one type transfer sheet among the plural type transfer sheets to the recording portion 300. In the recording portion 300, the transfer sheet is wrapped onto the image receiving sheet wounded on the drum 310 to overlap with it. Then, the laser exposure is applied to the transfer sheets superposed on the image receiving sheet based on the image information to be recorded. Since the toner on the portion, heated by the laser exposure, of the transfer sheet is adhered onto the image receiving sheet due to the degradation of the adhesive property, the melting, or the sublimation to be transferred onto it, the image is formed on the image receiving sheet. In addition, if the toners on the transfer sheets having plural different colors (for example, black, yellow, cyanogens, magenta) are adhered to the same image receiving sheet, the color image can be formed on the image receiving sheet. As described later, this can be achieved by the laser exposure executed after the exposed transfer sheet is exchanged into another color transfer sheet sequentially, while wrapping the image receiving sheet onto the drum 310 as it is.

The image receiving sheet on which this image is formed is ejected via the ejecting portion 400, and then picked up from the present recording apparatus. Then, the image receiving sheet is heated/pressurized in a separately provided image transfer portion (not shown) in the situation that its surface on which the image is formed is overlapped on the printing sheet as the printing object. Accordingly, the toner is transferred onto any printing sheet and thus the image is formed.

The above is an outline of the recording apparatus 1.

Next, the image receiving sheet supplying portion 100, the transfer sheet supplying portion 200, the recording portion 300, and the ejecting portion 400 will be explained in sequence respectively.

The image receiving sheet supplying portion 100 has an image receiving sheet roller 130. The image receiving sheet roller 130 is formed by wrapping an image receiving sheet 140 on its core. The image receiving sheet 140 has a supporting layer 142, an image receiving layer 144, and a cushion layer, and the cushion layer and the image receiving layer 144 are laminated sequentially on the supporting layer 142. In the image receiving sheet roller 130, the image receiving layer is wrapped on the outside of the supporting layer (the image receiving sheet wrapped in this manner is referred to as an "externally wrapped" image receiving sheet roller hereinafter). Also, the image receiving sheet roller 130 is provided such that it can be rotated around the center axis of the core.

The image receiving sheet supplying portion 100 has further an image receiving sheet carrying portion 150. The image receiving sheet carrying portion 150 comprises a motor (not shown), a drive transmitting belt or chain (not shown), carrying rollers 154 and 155, a supporting guide 156, an image receiving sheet cutting portion 160, and a sensor (not shown) for sensing end points of the image receiving sheet.

The carrying rollers 154 and the carrying rollers 155 have a pair of rollers respectively. According to such driving mechanism, the image receiving sheet 140 can be sent out to the recording portion 300 or be returned from the recording portion 300.

First, the image receiving sheet 140 is pulled out by the above-mentioned driving mechanism such as the motor, in the situation that a top end portion of the image receiving sheet roller 130 is put between the carrying rollers 154. Accordingly, the image receiving sheet roller 130 is turned and also the image receiving sheet 140 is fed out. The image receiving sheet 140 is sandwiched by the carrying rollers 155 and then guided by the supporting guide 156 to carry.

In this manner, the image receiving sheet 140 carried by the image receiving sheet carrying portion 150 is cut out by the image receiving sheet carrying portion 150 to have a predetermined length. A sensor is employed to measure the length. The length can be measured by sensing the top end of the image receiving sheet 140 by virtue of the sensor with regard to the rotation number of the motor, etc. The image receiving sheet 140 is cut at a predetermined length based on this measured result, and then supplied to the recording portion 300. The image receiving sheet cutting portion 160 has a cutter, a supporting portion, and a guide, although they are not shown. The carrying of the image receiving sheet 140 fed out from the image receiving sheet roller 130 by the above driving is stopped based on the measured result of the above image receiving sheet length, and then is cut by the cutter to have a predetermined length.

As described above, the image receiving sheet supplying portion 100 can supply the image receiving sheet 140 having a predetermined length to the recording portion 300 by feeding a part of the image receiving sheet roller 130 and then cutting the image receiving sheet.

Next, the transfer sheet supplying portion 200 will be explained hereunder.

The transfer sheet supplying portion 200 has a carrousel 210. As described later, this carrousel 210 is rotated around a rotating axis 213. Also, a plurality (six in FIG. 18) of transfer sheet rollers 230 are installed in the carrousel 210 and are arranged in a "radial fashion" around the rotating axis 213.

Each transfer sheet roller 230 has a core, transfer sheets 240 wrapped on the core, and flanges (not shown) which are inserted from both sides of the core. Each transfer sheet roller 230 is held rotatably around the core. Since an outer diameter of the flanges is set larger than a diameter of the transfer sheet portion, collapse of such transfer sheet portion can be prevented.

Each transfer sheet 240 has a supporting layer, a photothermal conversion layer, and a toner layer. The photothermal conversion layer and the toner layer are laminated in sequence on the supporting layer. In the transfer sheet roller 230, the toner layer is wrapped on the outside of the supporting layer (the transfer sheet roller wrapped in this manner is referred to as an "externally wrapped" transfer sheet roller hereinafter). As described later, the toner layer has toner ink, and this toner ink is transferred onto the image receiving sheet by the laser exposure.

In FIG. 18, the case where six transfer sheet rollers 230 are installed in the carrousel 210 is shown. As this six type transfer sheets, for example, four color transfer sheets of black (K), cyan (C), magenta (M), yellow (Y) and two special color transfer sheets (for example, gold, silver, etc.) may be employed.

The carrousel 210 has transfer sheet feeding mechanisms 250 corresponding to a plurality of transfer sheet rollers 230 respectively. The transfer sheet feeding mechanism 250 consists of a feed roller 254 and a supporting guide 256. In FIG. 18, six transfer sheet feeding mechanisms 250 are provided. The feed rollers 254 have a pair of rollers 254*a* and 254*b*. As described later, the roller 254*a* is connected to a motor by a gear mechanism and driven by the motor. The rollers 254*a*, 254*b* can put the transfer sheet 240 between them by a predetermined pressure. Then, the roller 254*b* rotates in the reverse direction to the roller 254*a* to carry the transfer sheet 240. The transfer sheet 240 can be held and fed out by the rollers 254*a*, 254*b* or can be returned oppositely by the rollers 254*a*, 254*b*. Also, the transfer sheet roller 230 is rotated according to the carry of the transfer sheet 240.

The transfer sheet 240 is supplied to the recording portion 300 by the transfer sheet feeding mechanisms 250 having such structure. The feed rollers 254 are driven by the above-mentioned driving mechanism such as the motor in the situation that a top end of the transfer sheet 240 is put between the feed rollers 254. The transfer sheet 240 is fed out by this driving. Also, the transfer sheet 240 is cut in a transfer sheet carrying portion 270, described later, to have a predetermined length and then supplied to the recording portion 300.

As described above, the carrousel 210 that installs a plurality of transfer sheet rollers 230 therein can supply selectively the desired type transfer sheet 240 to the transfer sheet carrying portion 270.

Also, the transfer sheet supplying portion 200 has the transfer sheet carrying portion 270. The transfer sheet carrying portion 270 comprises a motor (not shown), a drive transmitting belt or chain (not shown), carrying rollers 274, 275, a guide 276, a transfer sheet cutting portion 280, and a sensor (not shown) for sensing an end of the transfer sheet. The carrying rollers 274, 275 have a pair of rollers respectively. The rollers 274, 275 are connected to the motor via the drive transmitting belt or chain and driven by the motor to carry the transfer sheet 240. According to such driving mechanism, the transfer sheet 240 can be fed out to the recording portion 300 or can be returned oppositely.

Also, the transfer sheet 240 carried in this manner is cut by the transfer sheet cutting portion 280 to have a predetermined length. A sensor is utilized to measure the length of the transfer sheet 240. The length can be measured by sensing the end of the transfer sheet 240 by the sensor with regard to the revolution number of the motor, etc. The transfer sheet 240 is cut based on the measured result at a predetermined length and then supplied to the recording portion. Although not shown, the transfer sheet cutting portion 280 has a cutter, a supporting portion, a guide, etc.

As described above, the transfer sheet supplying portion 200 can supply the transfer sheet 240 having the predetermined length to the recording portion 300 by feeding out a part of the transfer sheet roller 230 and then cutting the transfer sheet.

When the transfer sheet 240 is exhausted, the used transfer sheet roller 230 must be detached and the transfer sheet 240 must be exchanged with the new transfer sheet 240.

The exchange of the transfer sheet roller 230 can be done by opening a lid 511. At this time, the transfer sheet roller 230 as the exchanged object is shifted previously to a predetermined exchanging position corresponding to the lid 511 by turning the carrousel 210. Also, the exchange of the image receiving sheet roller 130 is conducted by opening the lid 511.

Next, the recording portion 300 will be explained hereunder.

The recording portion 300 has a drum 310. The drum 310 has a hollow cylindrical shape, and is held rotatably by a frame (not shown). The drum 310 is coupled to a rotating axis of a motor and is rotated/driven by the motor. A plurality of hole portions are formed on a surface of the drum 310. These hole portions are connected to a suction apparatus (not shown) such as a blower, a vacuum pump, etc.

If the above image receiving sheet 140 and the transfer sheet 240 are loaded on the drum 310 and then the suction apparatus is operated, these sheets are sucked onto the drum 310.

Also, the drum 310 has a plurality of groove portions (not shown). The plurality of groove portions are provided on a straight line in parallel with the rotating axis of the drum 310.

Also, in order to enhance the adhesiveness between the image receiving sheet 140 and the transfer sheet 240, the overlapped portion between the image receiving sheet 140 and the transfer sheet 240 is slightly heated/pressed (squeeze process) by a heating/pressurizing roller 320 as the case may be. Also, a plurality of peeling claws (not shown) are provided over the drum 310 on a straight line in parallel with the rotating axis of the drum 310.

In addition, the recording portion has a recording head 350. The recording head 350 can emit the laser beam. The toner ink on the transfer sheet 240 at the position to which the laser beam is irradiated is transferred onto the surface of the image receiving sheet 140. Also, the recording head 350 can be moved linearly by a driving mechanism (not shown) in the direction in parallel with the rotating axis of the drum 310. Accordingly, the desired position on the transfer sheet for covering the image receiving sheet can be laser-exposed by a combination of the rotation motion of the drum 310 and the linear motion of the recording head 350. As a result, if only the corresponding position is laser-exposed based on the image information by scanning the transfer sheet by the laser beam serving as the drawing light beam, the desired image can be transferred onto the image receiving sheet 140.

Next, a wrapping operation of the image receiving sheet 140 and the transfer sheet 240 onto the drum 310 will be explained hereunder.

Two type sheets of the image receiving sheet 140 and the transfer sheet 240 are wrapped onto the drum 310. First, the image receiving sheet 140 supplied by the image receiving sheet supplying portion 100 is wrapped onto the drum 310. As described above, a plurality of hole portions 314 are formed on the surface of the drum 310 and the image receiving sheet 140 is sucked by the suction apparatus. Therefore, the image receiving sheet 140 is wrapped on the drum 310 with the rotation of the drum 310 while being sucked by the drum 310.

Then, a sheet of transfer sheet 240 supplied from the transfer sheet supplying portion 200 is wrapped on the image receiving sheet 140. Two type sheets of the image receiving sheet 140 and the transfer sheet 240 have different sizes mutually, and the transfer sheet 240 is larger than the image receiving sheet 140 in both the longitudinal direction and the lateral direction. Accordingly, the portion of the transfer sheet 240 larger than the image receiving sheet 140 is sucked by the drum 310. The transfer sheet 240 is wrapped on the drum 310 with the rotation of the drum 310 while being sucked by the drum 310. The image receiving sheet 140 and the transfer sheet 240 are wrapped onto the drum 310 such that the toner layer of the transfer sheet 240 exists on the image receiving layer to come into contact with the image receiving layer. As described above, the toner ink of the toner layer having such positional relationship is laser-expose by the recording head 350 and is transferred onto the image receiving sheet 140. The transfer sheet 240 whose transferring operation is completed is released from the drum 310.

Next, this releasing operation will be explained hereunder.

First, the drum 310 is rotated up to a predetermined position. Then, the position of the top end portion of the above releasing claw is moved from the standby position, which does not come into contact with the drum 310, to the contact position, which comes into contact with the drum 310. The top end portion of the releasing claw is caused at this motion not to contact to the transfer sheet 240. The releasing claw is moved relatively over the drum 310 in the peripheral direction along the surface of the drum 310 with the rotation of the drum 310. The top end portion of the releasing claw is moved relatively on the surface of the drum along the shapes of the groove portions to slip into the lower side of the transfer sheet 240. The transfer sheet 240 is moved along an upper surface of the releasing claw. The transfer sheet 240 is released from the drum 310. Then, the releasing claw is lifted in the direction to go away from the drum 310 and moved to the standby position before it comes into contact with the image receiving sheet 140. After the top end portion of the transfer sheet 240 is released, the drum 310 is continued to rotate and thus the transfer sheet 240 is then released from the drum 310 and the image receiving sheet 140. At this time, since the image receiving sheet 140 is still sucked onto the drum 310 by a suction force of the suction apparatus, only the transfer sheet 240 can be released.

Then, the transfer sheet 240 released by the above operation is ejected to the outside of the apparatus via a ejecting portion 400 described later.

Then, another color transfer sheet 240 is wrapped onto the image receiving sheet 140, that is still wrapped on the drum 310, in the procedure described above. Then, according to the above operation, the toner ink of the transfer sheet 240 is transferred onto the image receiving sheet 140 by the laser exposure and then the transfer sheet 240 is released and ejected.

The similar operation is repeated for the transfer sheets 240 of predetermined plural types. For example, if the above operation is repeated for four transfer sheets 240 of black, cyan, magenta, and yellow, the color image can be transferred onto the image receiving sheet 140.

Finally, in this manner, the image receiving sheet 140 on which plural type toner inks are transferred is released. The release of the image receiving sheet 140 is conducted in the similar way to the release of the transfer sheets 240. At this time, the releasing claw comes close to a plurality of groove portions to release the image receiving sheet 140 from the drum 310. Also, since the same releasing claw as that used to release the transfer sheet 240 can be utilized, the configuration can be simplified. As a result, the reliability of the apparatus can be improved.

The image receiving sheet 140 released as above is ejected to the ejecting portion 400.

Next, the ejecting portion 400 will be explained hereunder.

The ejecting portion 400 comprises a sheet common carrying portion 410, a transfer sheet ejecting portion 440, and an image receiving sheet ejecting portion 450.

The sheet common carrying portion 410 includes a motor (not shown), a drive transmitting belt or chain (not shown), carrying rollers 414, 415 and 416, supporting guides 418 and 419, and a sensor (not shown). Also, the sheet common carrying portion 410 has a mobile guiding portion which consists of a guide plate 438 and a driving mechanism (not shown). The guide plate 438 can be moved between two positions, described later, by the driving mechanism.

The image receiving sheet ejecting portion 450 has an image receiving sheet ejecting port 451, rollers 454 and 455, and a guide 458. The image receiving sheet 140 on which the image is transferred is ejected onto a tray 550 via the image receiving sheet ejecting portion 450.

Respective carrying rollers 414, 415, 416, 454 and 455 are constructed by two rollers as a set in the similar way to the above carrying rollers. If the rollers are rotated while sandwiching the image receiving sheet 140 and the transfer sheet 240 between two rollers, these sheets can be carried.

The ejecting portion 400 having such mechanism executes the eject of the image receiving sheet 140 and the eject of the transfer sheet 240 based on following operations.

First, the eject of the transfer sheet 240 will be explained hereunder.

The transfer sheet 240 that is subjected to the laser exposure in the recording portion 300 and becomes useless is released from the drum 310 as mentioned above. While supported by the releasing claw, the supporting guides 418, 419, and the guide plate 438, the released transfer sheet 240 can be held and fed out by the carrying rollers 414, 415, 416 to carry.

Then, the eject of the image receiving sheet 140 will be explained hereunder.

The image receiving sheet 140 is released from the drum 310, as described above, after the toner ink is transferred on the image receiving sheet 140 and processed in the recording portion 300. While supported by the releasing claw, the supporting guides 418 and 419, and the guide plate 438, the released image receiving sheet 140 can be held and fed out by the carrying rollers 414, 415 and 416 to carry. The sheet common carrying portion 410 is common to the case where the transfer sheet 240 is ejected, and thus the configuration can be simplified rather than the case the carrying portions are provided to respective sheets. In this case, in the sheet common carrying portion 410, the transfer sheet 240 is carried to direct the toner layer to the lower side and the image receiving sheet 140 is carried to direct the image receiving layer to the upper side. As a result, even if the image receiving sheet 140 and the transfer sheet 240 are carried sequentially by utilizing the same carrying path, there is no chance that the image formed on the image receiving layer of the image receiving sheet 140 is contaminated.

The image receiving sheet 140 is carried by the carrying rollers 414, 415 and 416, and is ejected to the outside of the apparatus. However, all the image receiving sheets 140 are not always ejected to the outside of the apparatus. In the situation that the rear end portion of the image receiving sheet 140 is located on the guide plate 438 and is held by the carrying rollers 416, the drive by the motor is stopped once, and then the image receiving sheet 140 is pulled back toward the image receiving sheet ejecting port 451 by rotating the motor reversely. That is, the "switch-back" operation is performed. The drive stopping timing is decided by using the signal supplied from the sensor. The sensor detects that the rear end of the image receiving sheet 140 passes through the position of the sensor, and then stops the drive of the motor 412 at a point of time when the image receiving sheet 140 is carried to reach a predetermined position. The predetermined position is such a position that the rear end of the image receiving sheet 140 is located on the guide plate 438 and held by the carrying rollers 416. It can be decided based on the number of the rotation pulses of the motor from a time point when the rear end is sensed by the sensor, whether or not the image receiving sheet 140 is moved by a predetermined distance to reach this position.

A guide blade 438 of the mobile guiding portion is driven by the driving mechanism (not shown) and can be moved between a broken line/a solid line shown in FIG. 18. The guide blade 438 is moved by this driving mechanism. Then, if the motor being stopped is rotated reversely, the carrying rollers 416, 454, 455, etc. are driven in the opposite direction. The image receiving sheet 140 is pulled back by this reverse rotation. Then, while supported by the guide 458, the image receiving sheet 140 is carried by the carrying rollers 454 and 455, and fed out to the tray 550. As described above, the image receiving sheet being sent out to the tray 550 is taken out from the present recording apparatus, and then additional processes are executed in the separately provided image transferring portion. As a result, the image can be printed on any printing paper.

The above operations can be controlled by a controlling portion (not shown).

The controlling portion controls the image receiving sheet supplying portion 100, the transfer sheet supplying portion 200, the recording portion 300, the ejecting portion 400, and others. The controlling portion controls the driving portions having the motors in above respective portions, and particularly controls the air portions such as the suction device, etc. and the image processing portion for processing the image data in the recording portion 300. Also, the driving portion for the transfer sheet supplying portion 200 has two driving systems, i.e., a rotation driving system for the carrousel 210 and a sheet-carry driving system for providing the transfer sheet 240 from the transfer sheet roller 230 to the drum 310. As described above, as with the motor drive in the sheet-carry driving system out of them, the motor driving driver is commonly used in a plurality of transfer sheet feeding mechanism. Thus, the driving circuit system can be simplified.

According to the above recording apparatus, the desired color image can be formed on the image receiving sheet 140. Operation procedures in the case where the color image is formed by using four colors of black, cyan, magenta, yellow will be explained in the following.

First, in step 1, the image receiving sheet supplying portion 100 supplies the image receiving sheet 140 to the drum 310. The image receiving sheet 140 is provided by feeding out a part of the externally wrapped image receiving sheet roll 130 and then cutting the image receiving sheet, and then wrapped on the drum 310.

Then, in step 2, the transfer sheet supplying portion 200 supplies the black transfer sheet 240 to the drum 310.

When the carrousel 210 of the transfer sheet supplying portion 200 is rotated, the black transfer sheet roller 230 is moved to the position facing to the transfer sheet carrying portion 270. The transfer sheet 240 is provided by feeding out a part of the externally wrapped transfer sheet roll 230 and then cutting the transfer sheet, and then wrapped on the drum 310. At this time, the top end of the transfer sheet 240 fed out from the transfer sheet roller 230 is positioned near the cutter 280 on the outside of the carrousel 210. At this time, after the transfer sheet 240 is fed, the transfer sheet feeding mechanism 250 can store the top end portion of the transfer sheet roller 230 at the inner side than the outer peripheral portion of the carrousel 210 by causing the feed rollers 254 to drive in the reverse direction. However, in this case, the feed rollers 254 still hold the top end.

Then, in step 3, the image is transferred and output onto the image receiving sheet 140 based on the image data given previously. Here, the given image data is color-separated into images for respective colors, and the laser exposure is performed based on the image data color-separated for respective colors. The recording head 350 irradiates the drawing light beam to the transfer sheet 240 based on the image data for respective colors after the color separation. The toner ink of the transfer sheet 240 is transferred onto the image receiving sheet 140, and then the image is formed on the image receiving sheet 140.

Then, in step 4, only the transfer sheet 240 is released from the drum 310. The transfer sheet 240 released from the drum 310 is ejected into a transfer sheet recovering box 540 via the ejecting portion 400.

Then, in step 5, it is decided whether or not the transfer of all color transfer sheets 240 is completed. Then, if another type transfer sheet 240 must be supplied, the processes in above steps 2 to 4 are repeated. That is, respective operation are repeated for the transfer sheets 240 of respective cyan, magenta and yellow colors. As a result, the toner inks of four color transfer sheets are transferred onto a sheet of image receiving sheet 140, and then the image is formed on the image receiving sheet 140.

When the above processes are ended, it is decided in step 5 that the laser exposure for the final transfer sheet 240 is completed.

Then, in step 6, the image receiving sheet 140 is released from the drum 310. The released image receiving sheet 140 is ejected into the tray 550 via the ejecting portion 400 by the switch-back operation. As for the ejected image receiving sheet 140, the toner ink on the image receiving sheet 140 is further transferred onto any printing paper in the separately provided image transferring portion. Accordingly, the proof-reading color printing is carried out.

In the recording apparatus described above, FIG. 1 is a perspective view showing the light beam profile emitted from the laser recording head employed by the present invention. The light intensity distributions in the main scanning direction and the sub-scanning direction show the almost rectangular shape respectively, and accordingly the light intensity distribution shows the almost rectangular parallelepiped.

The above is the profile of a single light beam, but the same is true of a plurality of light beams that are aligned one-dimensionally and two-dimensionally.

The particular implementing method of the rectangular parallelepiped light beam itself can be implemented by using the already-known optical technology. For example, the shaping method using the mirror, the method using the holography, the method using two phase conversion elements, etc. are considered. K. Nemoto, Central Research Institute of Electric Power Industry, 18-th Optical Symposium (1993) as the shaping method using the mirror, Chang-Yan Han, et al., Applied Optics, 22(22), pp.3644–3647 (1983) as the method using the holography, and Olof Bryngdahl, J.Opt.Soc.Am, 64, 1092–1099 (1974) as the method using two phase conversion elements may be listed.

Figure 19:
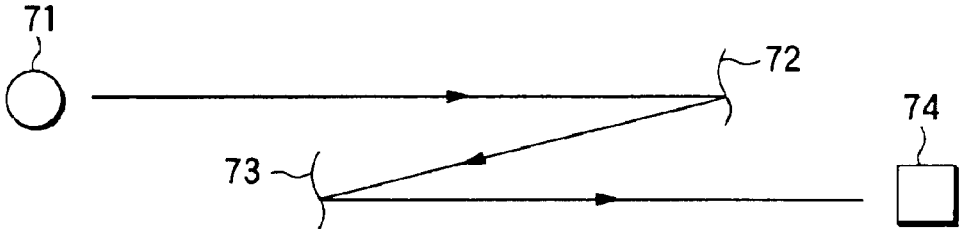
FIG. 19 is a conceptual view showing the laser beam shaping method employing a mirror as a phase conversion element.
Figure 20A:
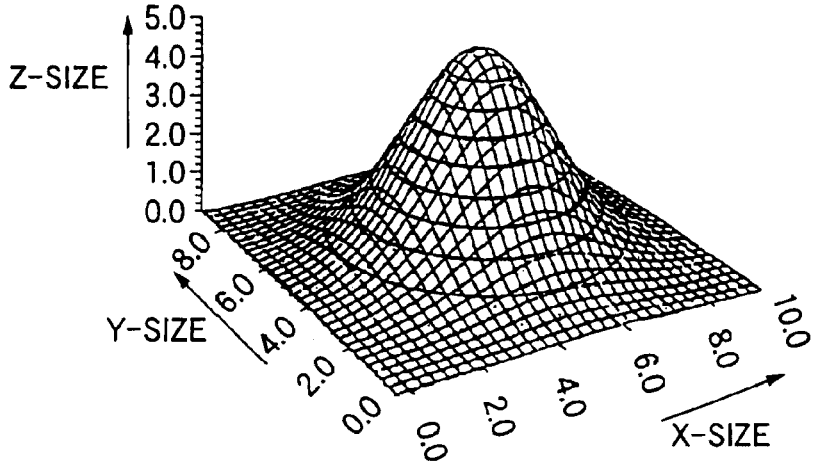
FIGS. 20 (*a*) through (*c*) are views showing results of the simulation employing the phase conversion element in FIG. 19.
Figure 20B:
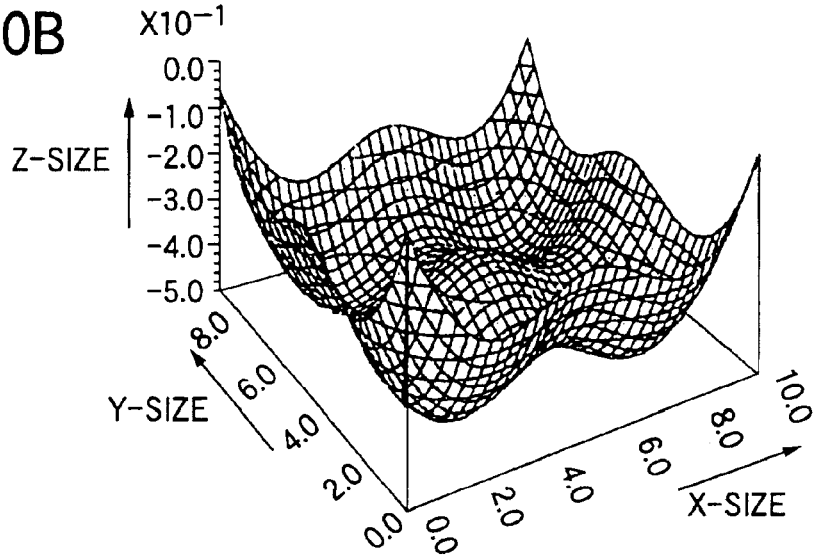
Figure 20C:
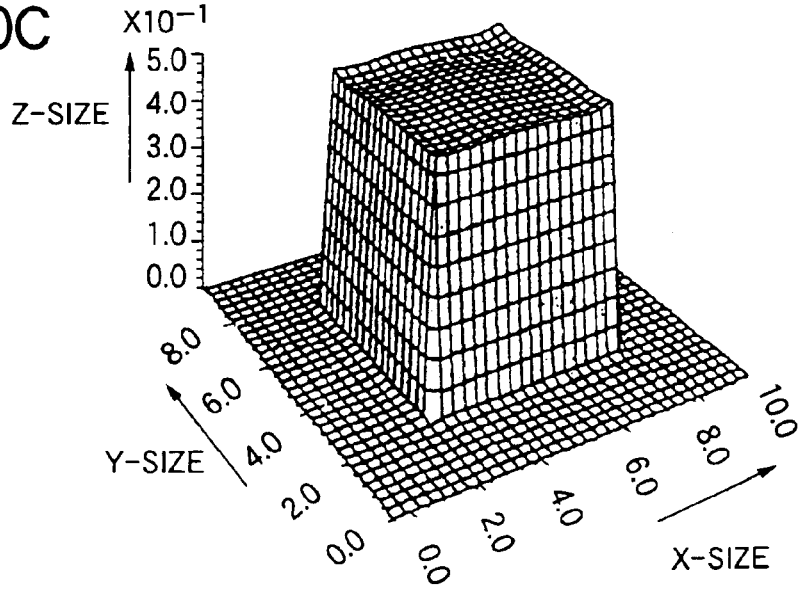

As an example, the method of shaping the circular Gaussian beam into the rectangular parallelepiped beam will be explained with reference to FIG. 19 and FIG. 20, based on the method proposed by Olof Bryngdahl. FIG. 19 and FIG. 20 are drafted with reference to the lecture contents of "Study of the Laser Beam Shaping Optical System" (K.Nemoto, T.Fujii and N.Gotoh) announced in the 18-th Optical symposium, "Concerning Design, Fabrication, Evaluation of the Optical System and the Optical Element" held at Research Institute for Production Technology, Tokyo University, on Jul. 7, 1993. FIG. 19 is a conceptual view showing the laser beam shaping method employing the mirror as the phase conversion element. FIG. 20 are views showing results of the simulation employing the phase conversion element in FIG. 19.

In FIG. 19, reference number 71 is an input laser beam (a sectional shape on the plane perpendicular to the traveling direction is the circle), reference number 72 is an intensity distribution conversion mirror, reference number 73 is a phase compensation mirror, and reference number 74 is an output laser beam (a sectional shape on the plane perpendicular to the traveling direction is the rectangle). Two mirrors (the intensity distribution conversion mirror 72 and the phase compensation mirror 73) change the phase of the wave front of the laser beam, whereby the intensity distribution conversion of the laser beam is performed. More particularly, the wave front of the laser beam is changed by the first phase conversion element to get the target intensity distribution when the laser beam propagates to a certain distance. In this case, since the intensity distribution becomes the target distribution but the phase distribution is changed, the wave front of the beam is changed into the wave front distribution such as the plane wave, which is suitable for the long distance propagation, by the second phase conversion element if the laser beam must be further propagated.

As the result of the simulation of the circular Gaussian beam shown in FIG. 20(*a*) by executing the fast Fourier transform of Fresnel-Kirchhoff's equation in the beam shaping method, the intensity distribution conversion mirror shown in FIG. 20(*b*) can be obtained. FIG. 20(*b*) shows the surface shape of the intensity distribution conversion mirror when the Gaussian beam whose $1/e^2$ width is 5 mm is converted into the rectangle whose one side is 5 mm. A size of this intensity distribution conversion mirror is 1 cm square, and an evenness is 6 $\mu$m. This unevenness can be adjusted by an interval between two sheets of mirrors. The converted shape is a shape at the position of the phase compensation mirror 73. An interval between two sheets of mirrors is 0.5 m, and the laser is the He—Ne laser.

Then, finally the rectangular parallelepiped light beam shown in FIG. 20(*c*) can be obtained.

Figure 1:
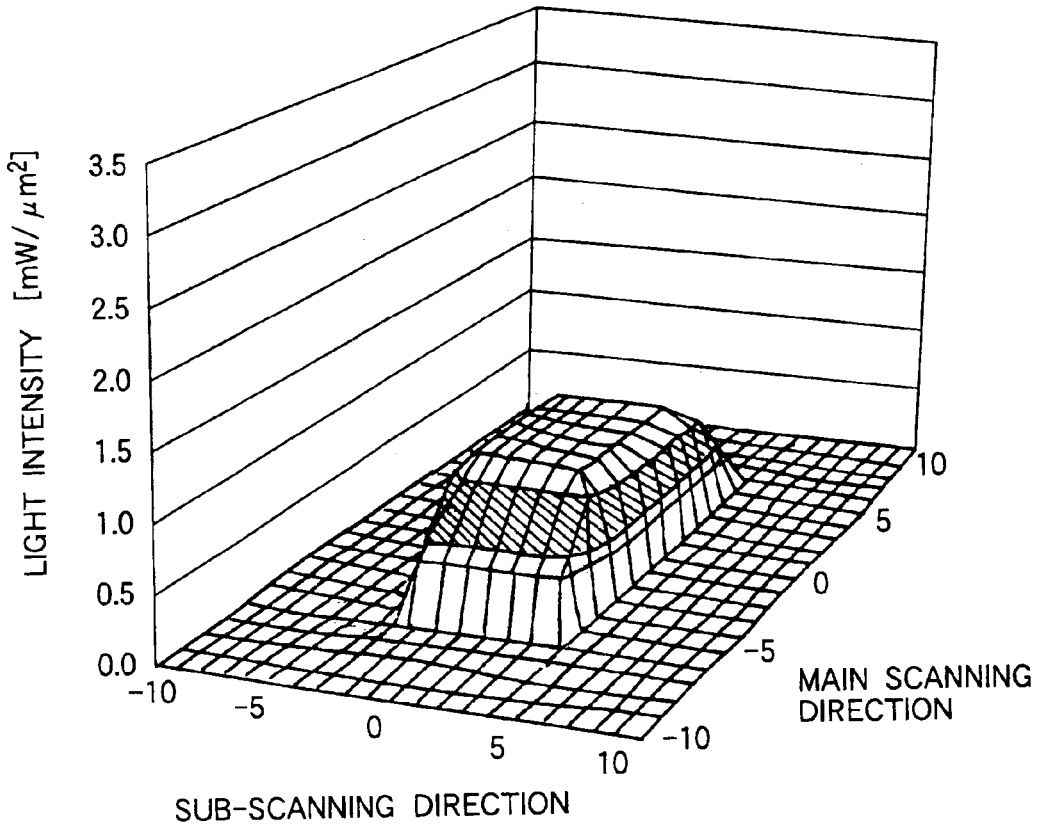
FIG. 1 is a view showing a rectangular parallelepiped light beam, that has constant light intensity distributions in a main scanning direction and a sub-scanning direction, according to the present invention.
Figure 2:
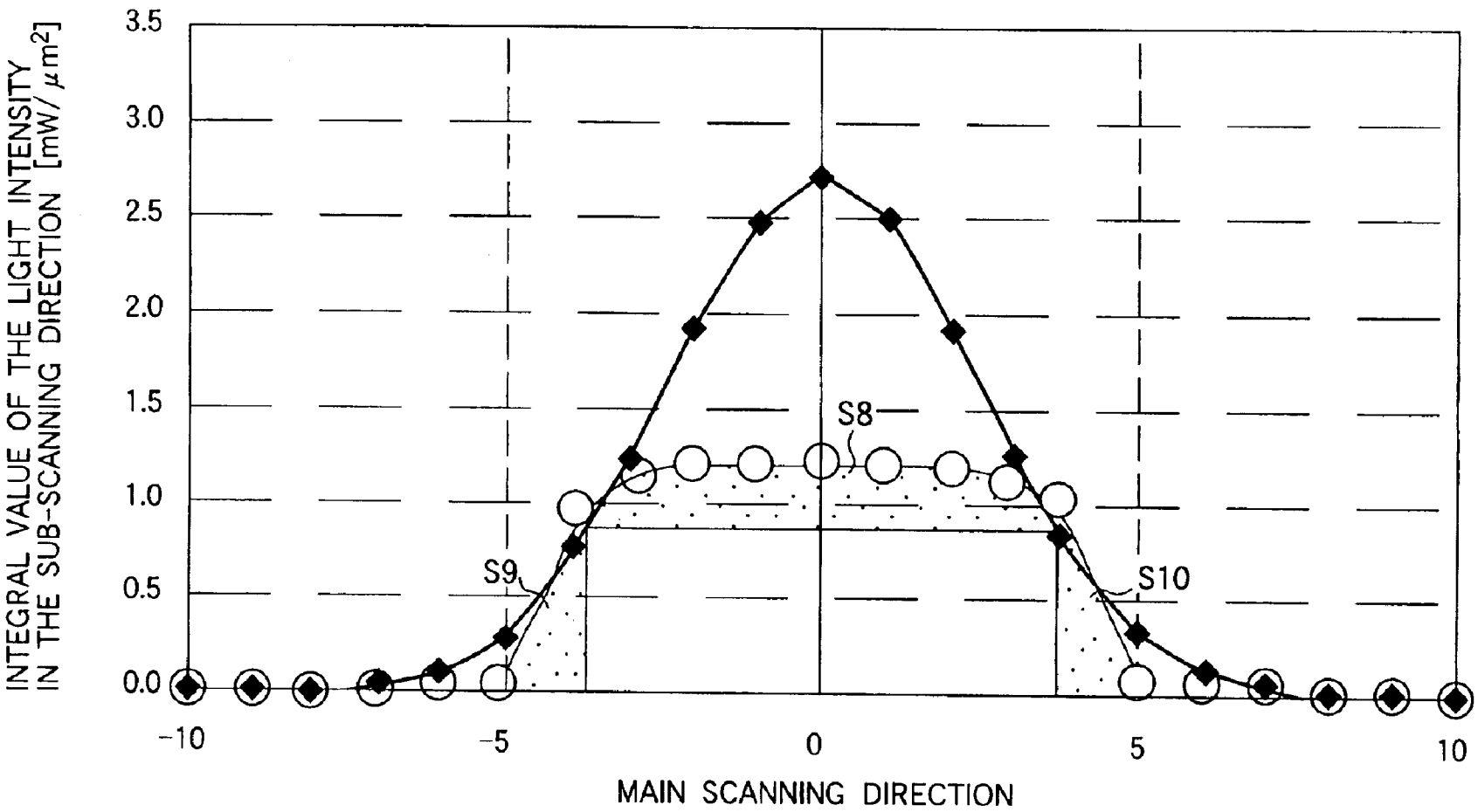
FIG. 2 is a graph showing integral values of the light intensity of the light beam, that has the profile in FIG. 1, in the sub-scanning direction every main scanning direction.
Figure 13:
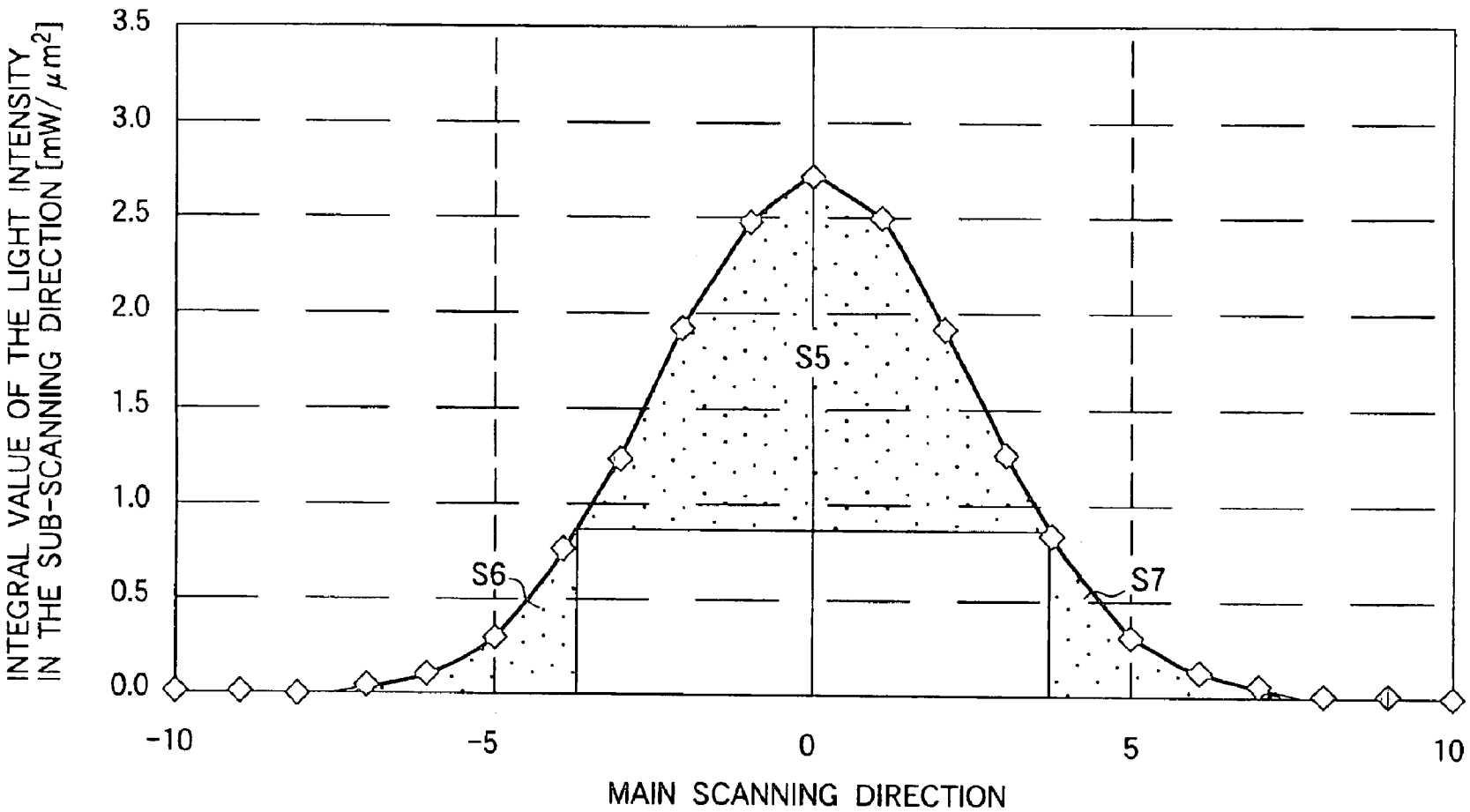
FIG. 13 is a graph showing integral values of the light intensity of the light beam, that has the profile in FIG. 9, in the sub-scanning direction every main scanning direction.

FIG. 2 is a graph showing integral values of the light intensity of the light beam, which has the profile shown in FIG. 1, in the sub-scanning direction every main scanning direction. "○" is a spot in FIG. 1. "◆" is a spot in FIG. 9, which is prepared by tracing FIG. 13 for the sake of comparison with the present invention. In FIG. 2, according to the rectangular parallelepiped light beam of the present invention, it can be understood that the peak value is about 1.2 to 1.3 (mW/$\mu$m2) at best and thus, if the threshold level of the integral value of the recordable light intensity in the sub-scanning direction is assumed as 0.9 (mW/$\mu$m2), the wasteful energy can be reduced considerably since the value corresponding to the difference (S8 portion) is not so large in contrast to S5 in FIG. 13.

Figure 10:
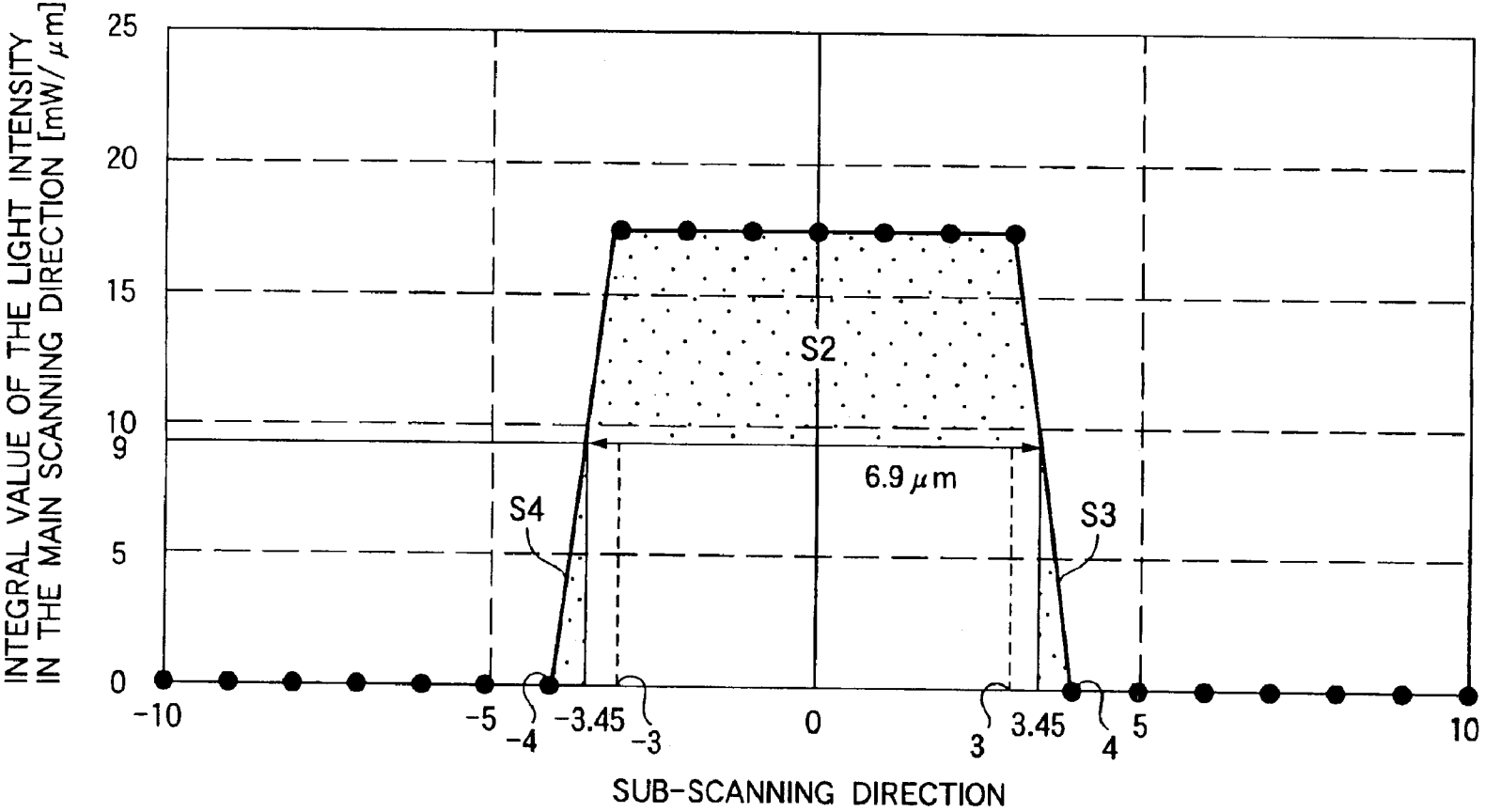
FIG. 10 is a graph used to calculate a thickness of the line that is recorded by the light beam in FIG. 9 at a predetermined velocity.
Figure 11:
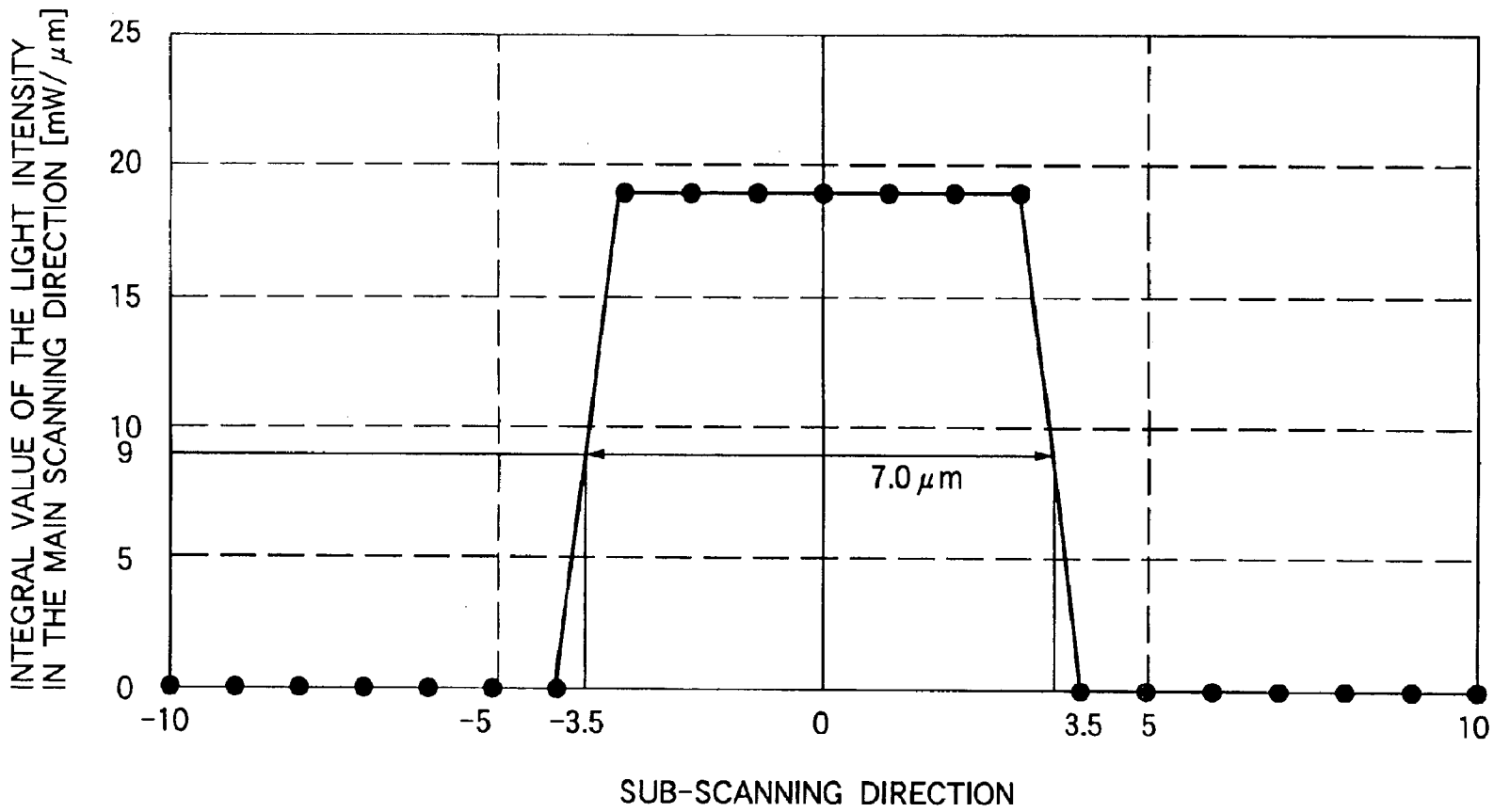
FIG. 11 is a graph used to calculate a thickness of the line when a power of the light beam in FIG. 9 is varied to increase by 10%.
Figure 12:
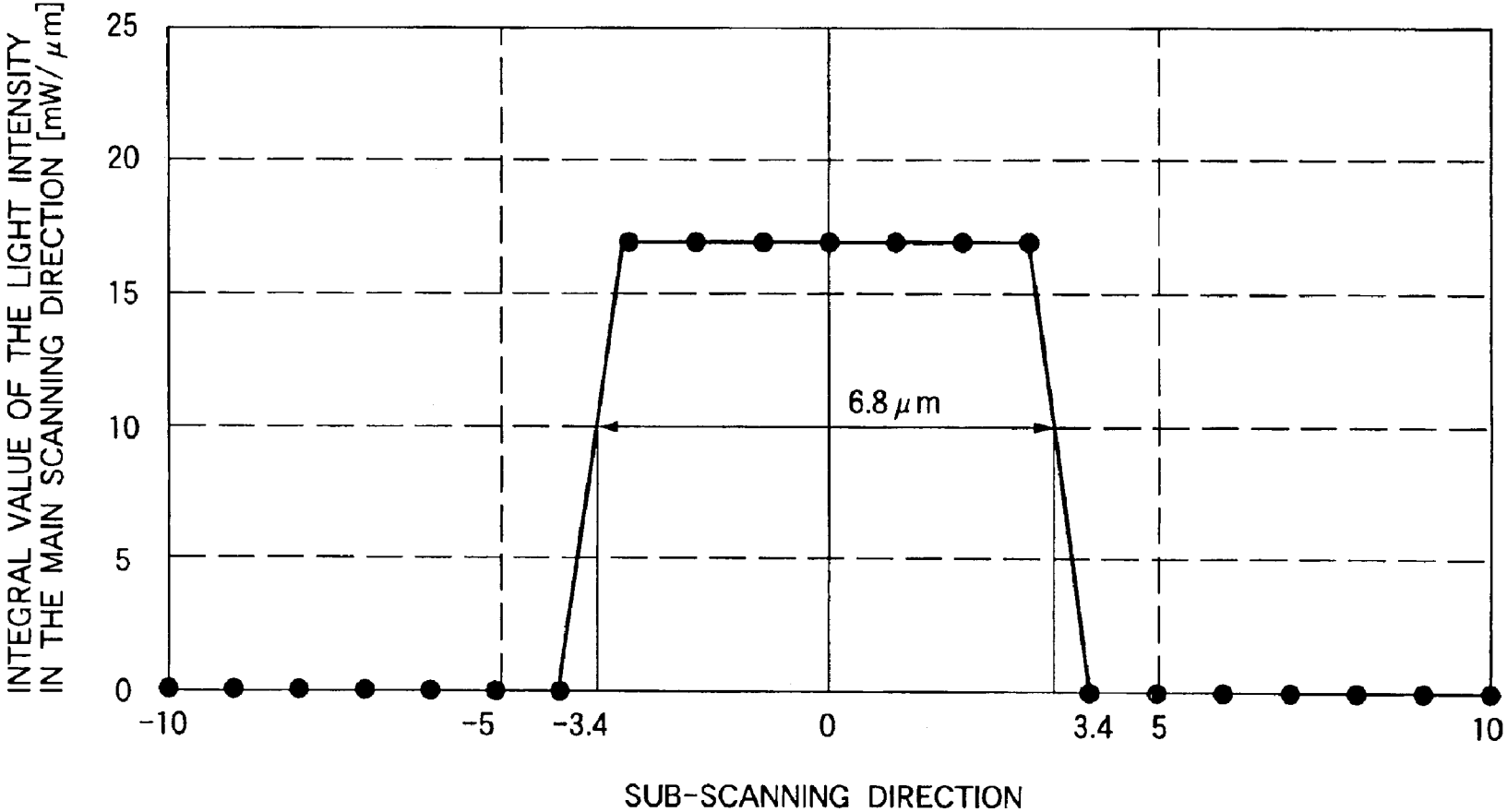
FIG. 12 is a graph used to calculate a thickness of the line when the integral value of the power of the light beam in FIG. 9 exceeds almost 10 mW/$\mu$m by influences of a humidity and a recording velocity.

Also, the integral value of the light intensity below the threshold level, that does not effect the recording, appears on both sides (S9 portion, S10 portion), but it can be understood that the optical energy used wastefully when the recording is not executed is small by comparing these values with the S3, S4 portions in FIG. 10.

Figure 3A:
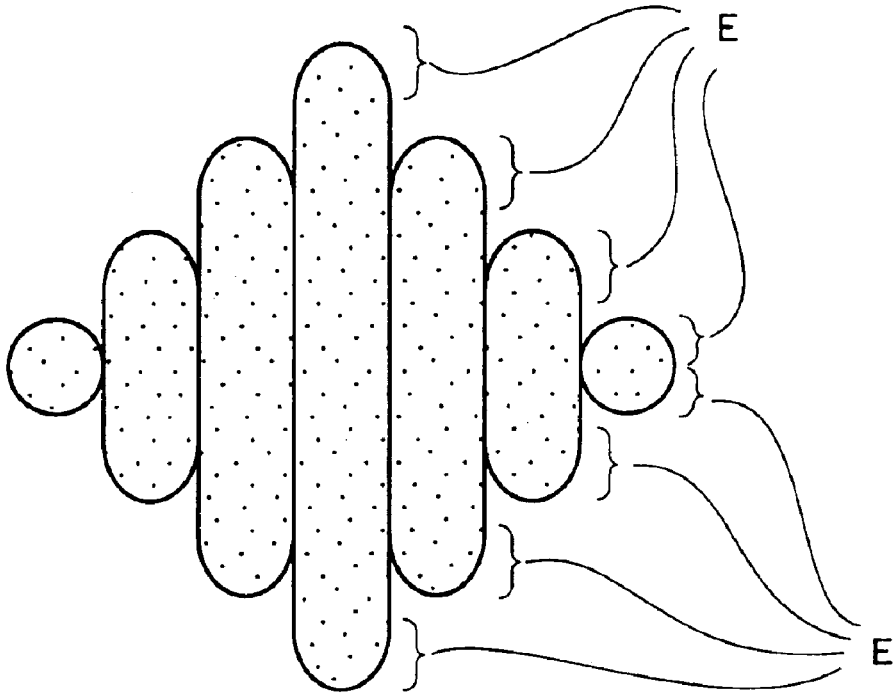
FIG. 3 is a view showing an end shape of a recording dot of a halftone dot edge of a spot when an image is recorded by an area tone, (a) is the end shape by a round light beam in FIG. 4, and (b) is the end shape by the rectangular parallelepiped light beam in FIG. 1 according to the present invention.
Figure 3B:
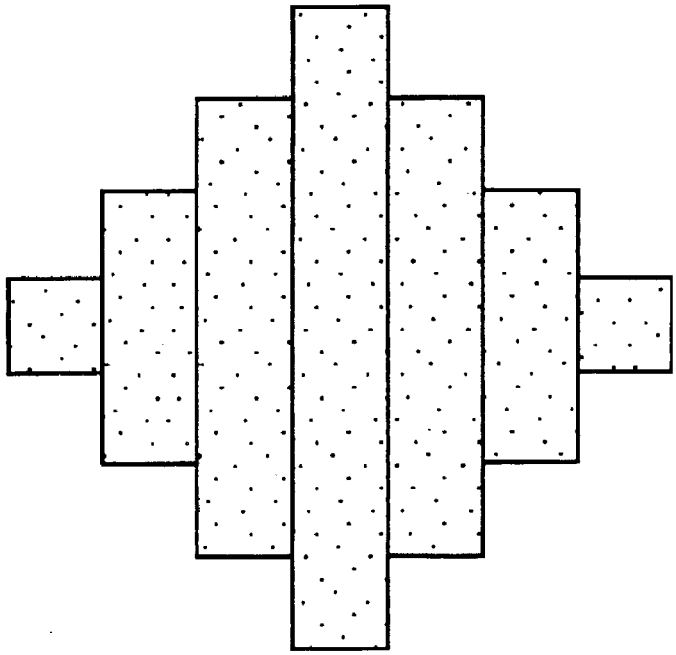
Figure 4:
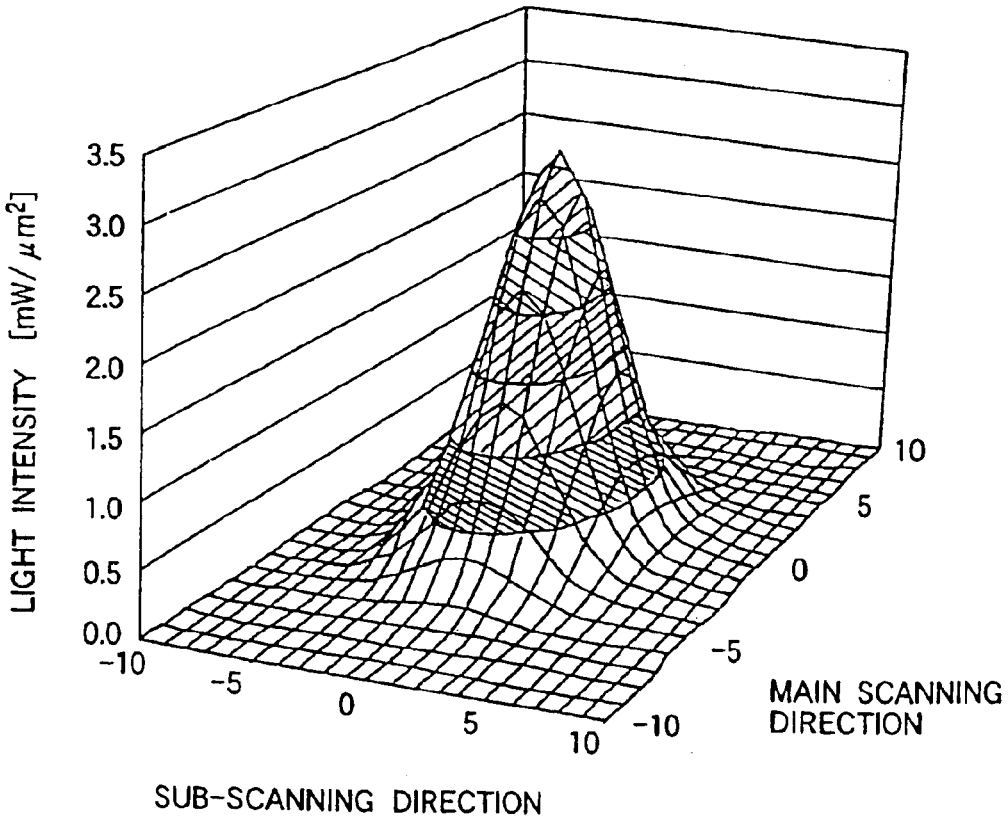
PRIOR ART FIG.4
FIG. 4 is a view showing the light beam having light intensity distributions of the Gaussian profile in both the sub-scanning direction and the main scanning direction in the prior art.
Figure 5:
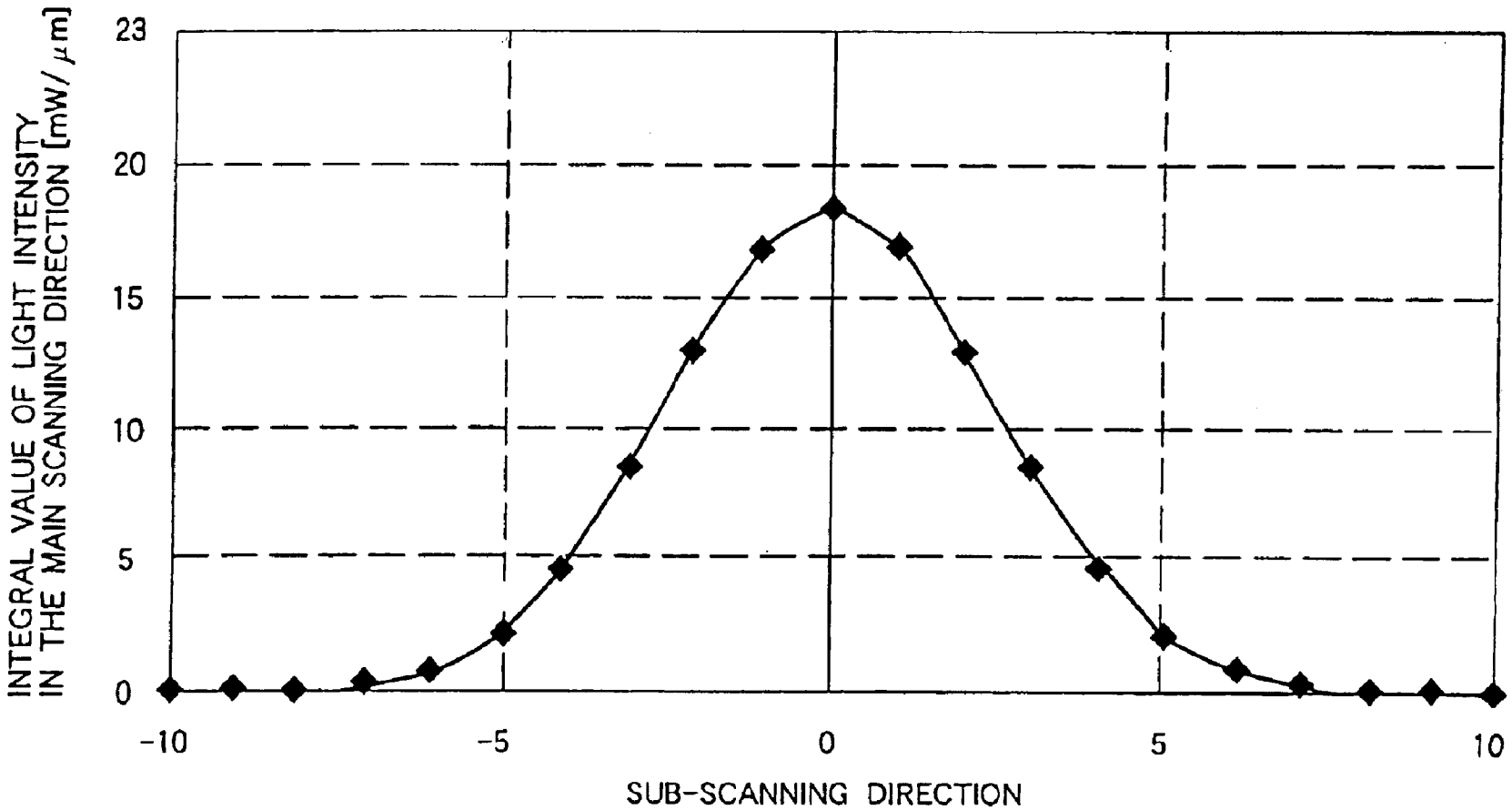
FIG.5 PRIOR ART
FIG. 5 is a graph showing integral values of the light intensity of the light beam, that has the profile in FIG. 4, in the main scanning direction every sub-scanning direction.
Figure 6:
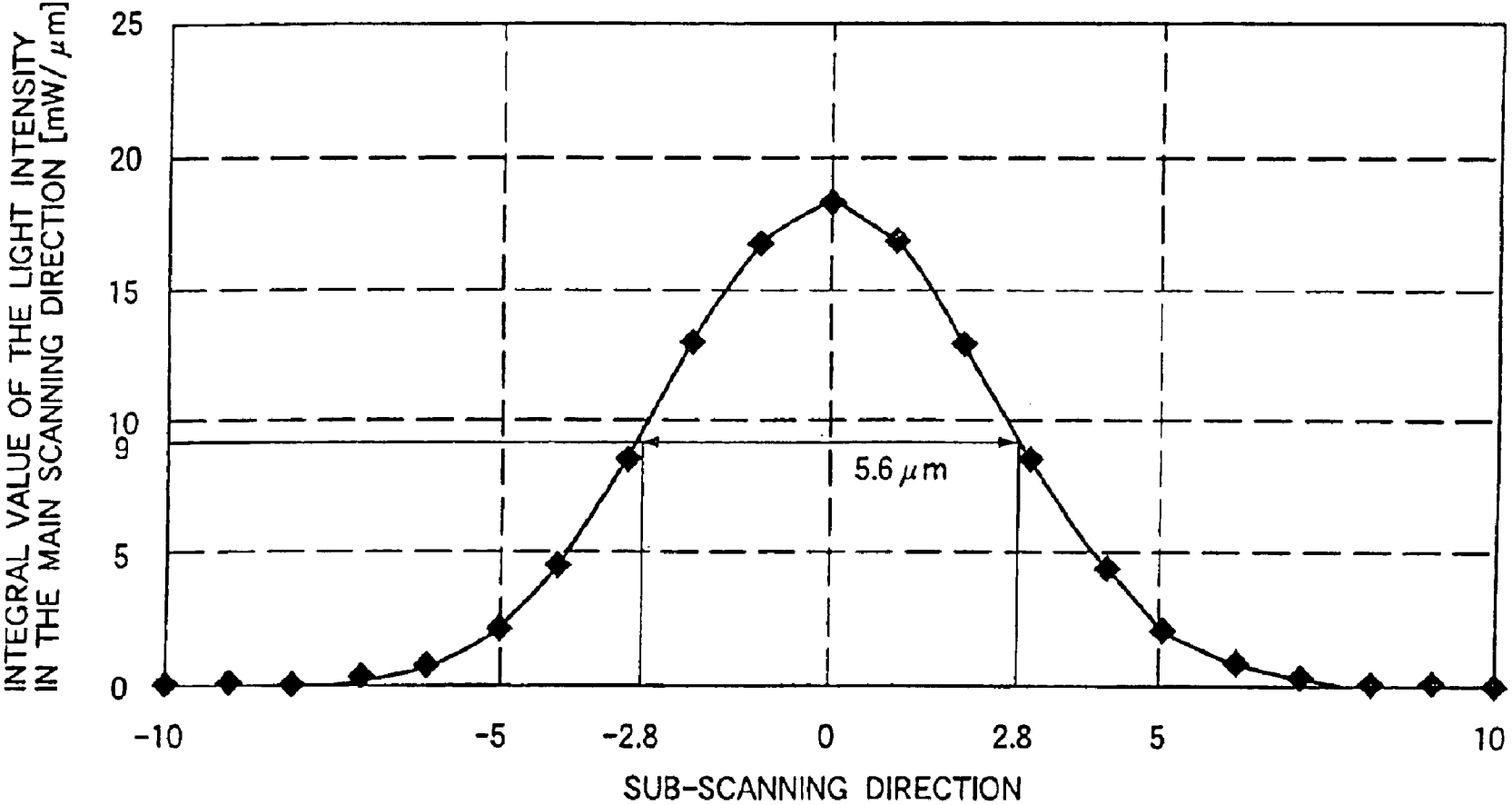
FIG.6 PRIOR ART
FIG. 6 is a graph used to calculate a thickness of the line that is recorded by the light beam in FIG. 4 at a predetermined velocity.
Figure 7:
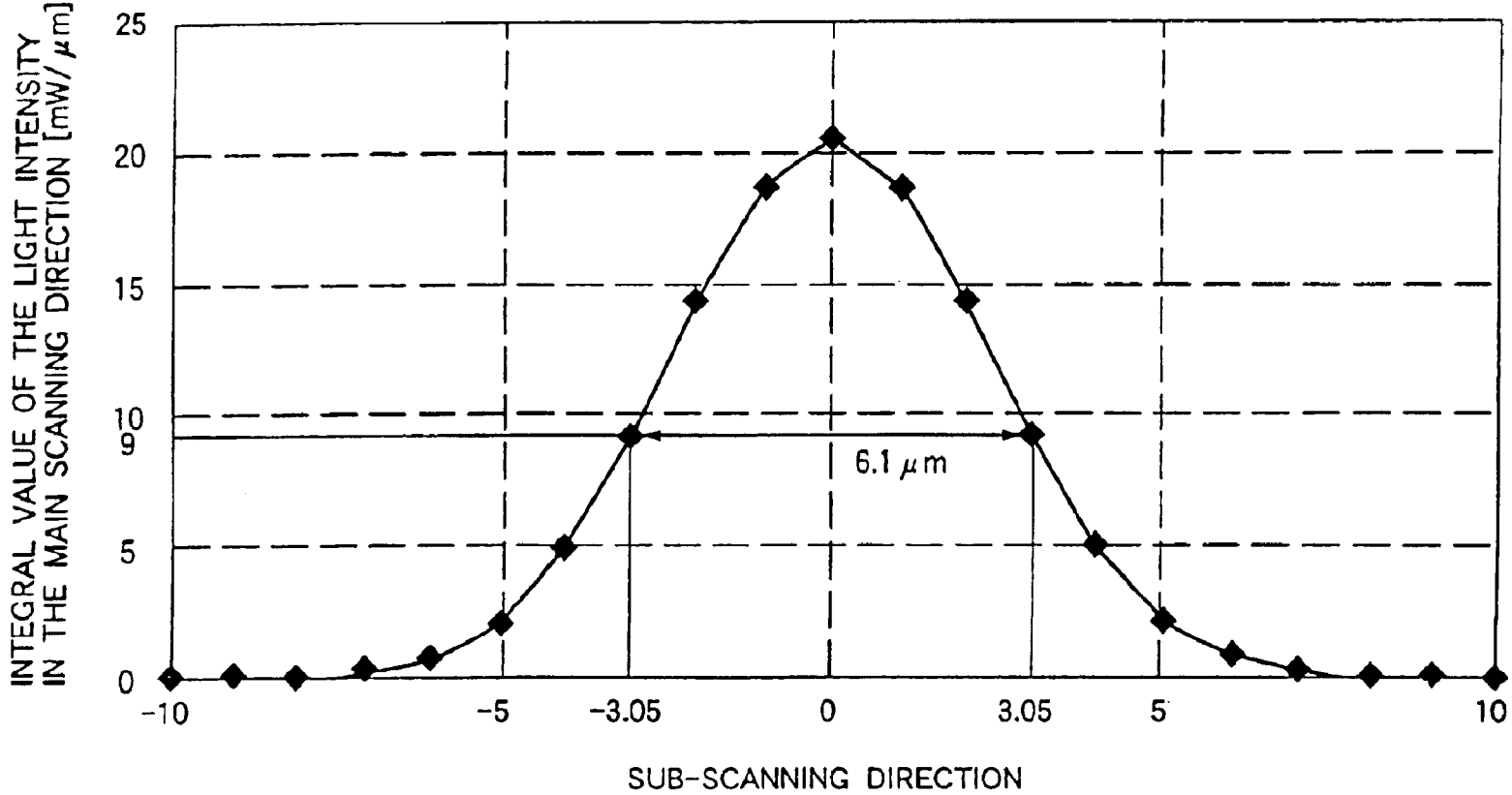
PRIOR ART FIG.7
FIG. 7 is a graph used to calculate a thickness of the line when a power of the light beam in FIG. 4 is varied to increase by 10%.
Figure 8:
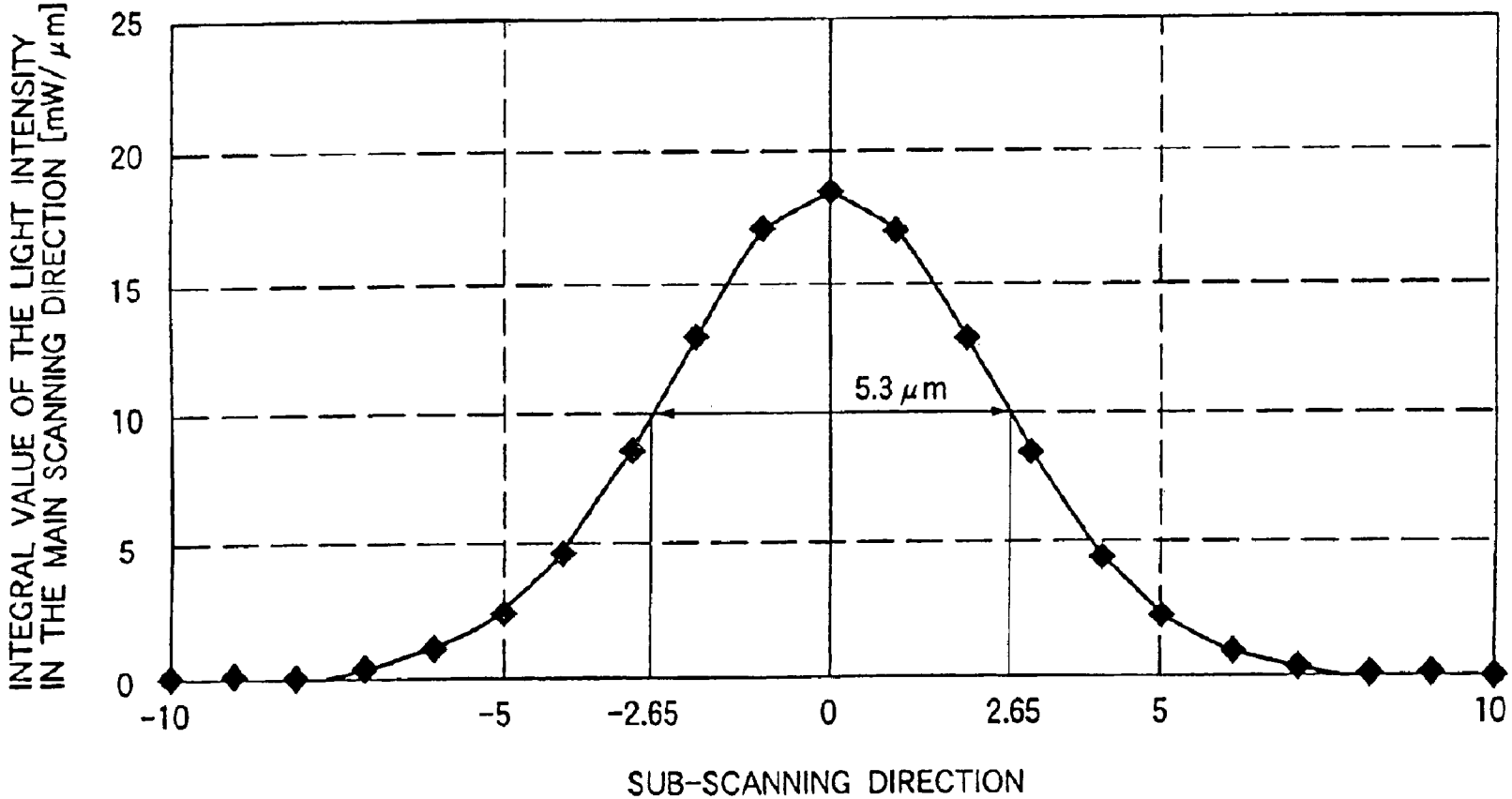
FIG.8 PRIOR ART
FIG. 8 is a graph used to calculate a thickness of the line when the integral value of the power of the light beam in FIG. 4 exceeds almost 10 mW/$\mu$m by influences of a humidity and a recording velocity.

Also, if the recording is executed in the area gradation level based on the image data for the printing halftone dots, the halftone dot edge of the round spot shown in FIG. 4 appears like "rounded shape" E such that the start end and rear end of the recording dot are rounded, as shown in FIG. 3(*a*). In contrast, since the rectangular parallelepiped spot according to the present invention shown in FIG. 1 has the rectangular lateral sectional shape, the start end and rear end of the recording dot are not rounded, as shown in FIG. 3(*b*).

Also, the binary heat mode recording medium used in the present invention can record the image in a viewpoint of the light intensity (not integrated) if the light exceeding the predetermined light intensity (threshold) is irradiated for a predetermined time. However, even if the light below the predetermined light intensity (threshold) is irradiated for a long time, the image cannot be recorded.

Figure 9:
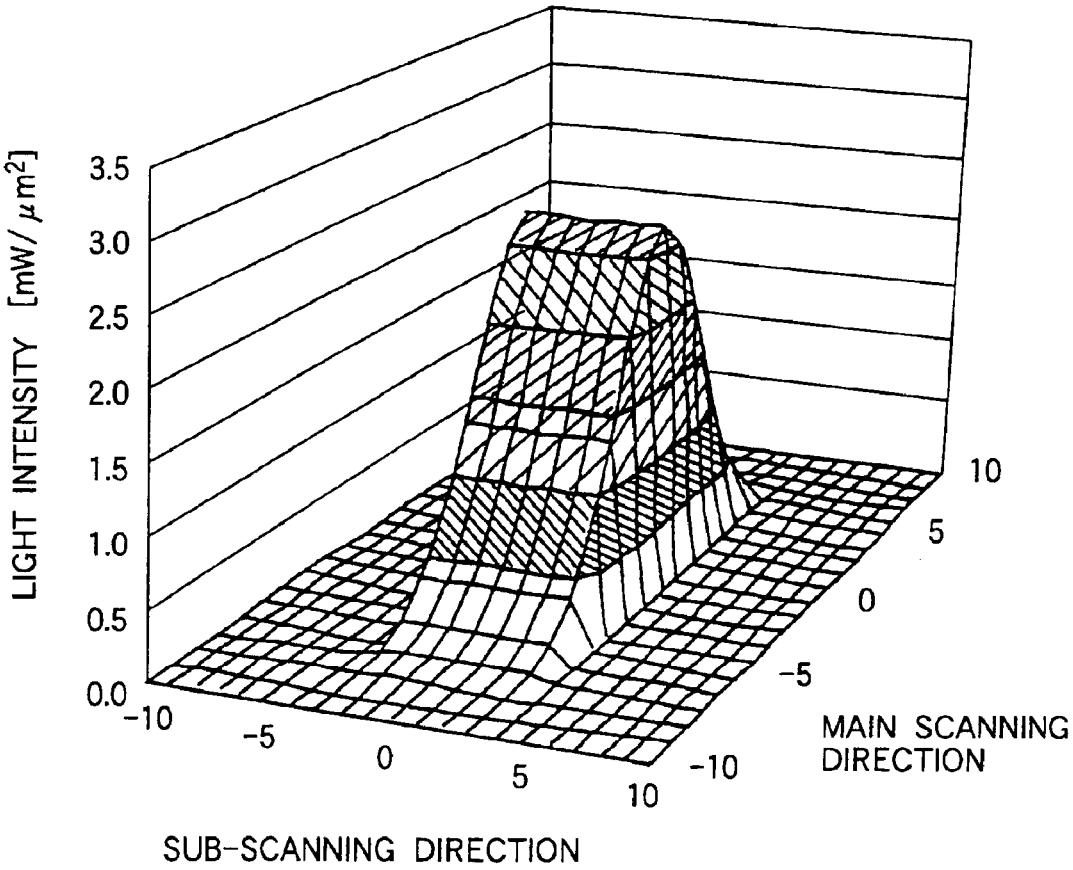
FIG. 9 is a view showing the light beam that has the constant light intensity distribution in the sub-scanning direction and the light intensity distribution of the Gaussian profile in the main scanning direction.

When the image is recorded by using the above recording apparatus, the length in the main scanning direction of the light intensity threshold of about 1 (mW/$\mu$m$^2$) becomes almost identical although the total power of the light beam is smaller than the Gaussian light beam shown in FIG. 4 and the one-sided Gaussian light beam shown in FIG. 9 in the prior art by about 20%.

Also, the portion larger than the light intensity threshold of about 0.7 (mW/$\mu$m$^2$) becomes smaller than the Gaussian profile. Accordingly, the portion not contributing to the recording can be reduced and thus the wasteful light energy can be reduced.

In addition, the portion smaller than the light intensity threshold of about 0.7 (mW/$\mu$m$^2$) becomes smaller than the Gaussian profile. Accordingly, the portion not to contribute the recording can be reduced and thus the wasteful light energy can be reduced.

As described above, since the large light intensity portion and the small light intensity portion can be clearly separated by the light intensity threshold of about 0.7 (mW/$\mu$m$^2$), the recording becomes highly sensitive. Also, if one dot is recorded, the size of the recorded dot is ready to change by the recording conditions (for example, recording velocity (recording drum peripheral velocity), circumstances (temperature, humidity), power variation, etc.) since the Gaussian light beam shown in FIG. 4 and the one-sided Gaussian light beam shown in FIG. 9 have the smooth portion of the light intensity, but the good recording property of the fine line can be achieved according to the present invention.

In the case that the image is recorded in the area tone, the rounded E of the rear end of the recording dot as shown in FIG. 3(*a*) can be eliminated if the halftone dot edge of the rounded spot as shown in FIG. 4 is employed.

What is claimed is:

1. A recording method of recording images and characters onto a recording medium overlapping a toner layer of the transfer film, that is a binary heat mode recording medium, and an image receiving layer of a receiver film to fix them onto a recording medium fixing member, setting a moving direction of the recording medium as a main scanning direction, and moving a laser recording head, that emits a light beam onto the recording medium, in a sub-scanning direction that is perpendicular to the main scanning direction, wherein the light beam from the laser recording head, which is provided with at least a multimode laser device for emitting a set of laser spot beams whose profile is substantially rectangular in the sub-scanning direction, and a conversion mirror for converting a light intensity distribution in the main scanning direction to a substantially rectangular profile, is employed, whereby, a set of rectangular lateral sectional shapes corresponding to the set of laser spot beams can be formed on the binary heat mode recording medium, and wherein a threshold level of an integral value of the light intensity in the sub-scanning direction is 0.9 (mW/$\mu$m$^2$).

* * * * *